US010892069B2

(12) United States Patent
Gundel

(10) Patent No.: US 10,892,069 B2
(45) Date of Patent: Jan. 12, 2021

(54) CONDUCTOR SET AND RIBBON CABLE

(71) Applicant: 3M INNOVATIVE PROPERTIES COMPANY, St. Paul, MN (US)

(72) Inventor: Douglas B. Gundel, Cedar Park, TX (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 16/850,214

(22) Filed: Apr. 16, 2020

(65) Prior Publication Data

US 2020/0243224 A1 Jul. 30, 2020

Related U.S. Application Data

(62) Division of application No. 16/181,661, filed on Nov. 6, 2018, now Pat. No. 10,665,366.

(60) Provisional application No. 62/608,617, filed on Dec. 21, 2017.

(51) Int. Cl.

| | |
|---|---|
| ***H01B 11/20*** | (2006.01) |
| ***H01B 7/08*** | (2006.01) |
| ***H01B 7/02*** | (2006.01) |
| ***H01B 3/30*** | (2006.01) |
| ***H01B 3/44*** | (2006.01) |

(52) U.S. Cl.

CPC ..... *H01B 11/203* (2013.01); *H01B 3/302* (2013.01); *H01B 3/305* (2013.01); *H01B 3/306* (2013.01); *H01B 3/441* (2013.01); *H01B 3/445* (2013.01); *H01B 7/0216* (2013.01); *H01B 7/0823* (2013.01); *H01B 7/0838* (2013.01)

(58) Field of Classification Search

CPC ..... H01L 11/203; H01L 3/302; H01L 3/305; H01L 3/306; H01L 3/441; H01L 3/445; H01L 7/0216; H01L 7/0823

USPC ..... 174/102 R

See application file for complete search history.

(56) References Cited

U.S. PATENT DOCUMENTS

| | | | | |
|---|---|---|---|---|
| 4,436,953 A | | 3/1984 | Cottlieb | |
| 4,468,089 A | * | 8/1984 | Brorein | G02B 6/4403 156/53 |
| 4,481,379 A | * | 11/1984 | Bolick, Jr. | H01B 7/0838 174/117 F |

(Continued)

FOREIGN PATENT DOCUMENTS

| | | |
|---|---|---|
| EP | 0082700 | 6/1983 |
| GB | 1458065 | 12/1976 |

(Continued)

*Primary Examiner* — Timothy J Thompson
*Assistant Examiner* — Michael F McAllister
(74) *Attorney, Agent, or Firm* — Clifton F. Richardson

(57) ABSTRACT

A ribbon cable can include a plurality of spaced apart substantially parallel conductor sets. The conductor set includes a plurality of spaced apart substantially parallel conductors extending along a length of the conductor set and arranged along a width of the conductor set; first and second non-conductive structured layers disposed on opposite sides of and substantially coextensive with the plurality of conductors along the length and width of the conductor set; and a conductive shielding layer wrapped around the first and second non-conductive structured layers. Each structured layer is adhered to the conductors and includes a plurality of higher dielectric constant regions defining a plurality of lower dielectric constant regions therebetween.

17 Claims, 14 Drawing Sheets

(56) References Cited

U.S. PATENT DOCUMENTS 4,487,992 A 12/1984 Tomita
4,783,579 A * 11/1988 Brandolf ..... B29C 48/07 174/117 FF
5,025,115 A 6/1991 Sayegh
5,175,030 A 12/1992 Lu
5,183,597 A 2/1993 Lu
5,250,127 A * 10/1993 Hara ..... H01B 7/385 156/247
5,262,589 A 11/1993 Kesler
5,306,869 A * 4/1994 Springer ..... H01B 7/0861 156/53
5,327,513 A 7/1994 Nguyen
5,611,017 A * 3/1997 Lee ..... G02B 6/3839 385/114
5,885,710 A * 3/1999 MacDonald, Jr. ... H01B 7/0861 174/117 F
5,900,588 A * 5/1999 Springer ..... H01B 7/0861 174/117 F
6,322,236 B1 11/2001 Campbell
7,328,638 B2 2/2008 Gardiner
7,350,442 B2 4/2008 Ehnes
8,492,655 B2 7/2013 Gundel
8,679,607 B2 3/2014 Hamer
8,859,901 B2 10/2014 Gundel
8,946,558 B2 * 2/2015 Gundel ..... H01B 7/0823 174/117 F
9,520,209 B2 * 12/2016 Chiu ..... H01B 3/10
2003/0214802 A1 * 11/2003 Fjelstad ..... H05K 1/024 361/826
2006/0207784 A1 9/2006 Chang
2007/0240898 A1 * 10/2007 Reichert ..... H01B 7/0838 174/117 F
2012/0064296 A1 3/2012 Walker, Jr.
2012/0285723 A1 11/2012 Gundel
2013/0233590 A1 * 9/2013 Shanai ..... C09J 7/22 174/117 F
2017/0133126 A1 * 5/2017 Poehmerer ..... H01B 11/1821
2017/0243677 A1 8/2017 Wu et al.

FOREIGN PATENT DOCUMENTS

WO WO 2012-138729 10/2012
WO WO 2013-074149 5/2013
WO WO 2015-0088751 6/2015

* cited by examiner

CONDUCTOR SET AND RIBBON CABLE

BACKGROUND

Electrical cables for transmission of electrical signals are well known. One common type of electrical cable is a coaxial cable. Coaxial cables generally include an electrically conductive wire surrounded by an insulator. The wire and insulator are surrounded by a shield, and the wire, insulator, and shield are surrounded by a jacket. Another common type of electrical cable is a shielded electrical cable that includes one or more insulated signal conductors surrounded by a shielding layer formed, for example, by a metal foil.

SUMMARY

In some aspects of the present description, a ribbon cable including a plurality of spaced apart substantially parallel conductors extending along a length of the cable and arranged along a width of the cable; and first and second insulative layers disposed on opposite sides of and substantially coextensive with the plurality of conductors along the length and width of the cable is provided. Each insulative layer is adhered to the conductors and includes alternating substantially parallel thicker and thinner portions extending along the length of the cable. The thicker portions of the first and second insulative layers substantially aligned and in one to one correspondence. Each corresponding thicker portions of the first and second insulative layers have at least one conductor in the plurality of conductors disposed therebetween.

In some aspects of the present description, a conductor set including a plurality of spaced apart substantially parallel conductors extending along a length of the conductor set and arranged along a width of the conductor set; first and second non-conductive structured layers disposed on opposite sides of and substantially coextensive with the plurality of conductors along the length and width of the conductor set; and a conductive shielding layer wrapped around the first and second non-conductive structured layers is provided. Each structured layer is adhered to the conductors and includes a plurality of higher dielectric constant regions defining a plurality of lower dielectric constant regions therebetween In some aspects of the present description, a ribbon cable including a plurality of substantially parallel insulated conductors extending along a length of the cable and arranged along a width of the cable; and an insulative layer surrounding and adhered to the plurality of the insulated conductors is provided. Each insulated conductor has a diameter R and the conductor of the insulated conductor has a diameter r, where R/r is greater than 1 and less than about 2. For each pair of adjacent insulated conductors in the plurality of insulated conductors, a center to center separation between the two insulated conductors is D, an average of the diameters of the two insulated conductors is d, and D/d≥1.05.

In some aspects of the present description, a ribbon cable including a plurality of spaced apart substantially parallel insulated conductors extending along a length of the cable and arranged along a width of the cable; and an insulative layer surrounding and adhered to the plurality of the insulated conductors is provided. At least one insulated conductor is insulated with a dielectric material having a dielectric constant of at least W. An effective dielectric constant of the cable for a pair of adjacent insulated conductors that includes the at least one insulated conductor driven with differential signals of equal amplitude and opposite polarities is less than 0.8 times W.

In some aspects of the present description, a ribbon cable including a plurality of substantially parallel insulated conductors extending along a length of the cable and arranged along a width of the cable; and an insulative layer surrounding the plurality of the insulated conductors is provided. Each conductor in at least one pair of adjacent insulated conductors is insulated with a dielectric material having a dielectric constant greater than about 2. A center to center separation between the two adjacent insulated conductors is D, an average of the diameters of the two insulated conductors is d, and D/d≥1.05. The insulative layer has a thickness greater than about 200 microns and an effective dielectric constant of less than about 2. The dielectric material has an adhesive property and directly bonds the insulated conductors to the insulative layer. An effective dielectric constant of the cable for at least one pair of adjacent insulated conductors driven with differential signals of equal amplitude and opposite polarities is less than about 2.5.

In some aspects of the present description, a ribbon cable including a plurality of spaced apart substantially parallel insulated conductors extending along a length of the cable and arranged along a width of the cable; and first and second insulative layer portions disposed on opposite sides of and substantially coextensive with the plurality of insulated conductors across the length and width of the cable is provided. Each insulated conductor is insulated with a dielectric material having a thickness≥0. For each pair of adjacent insulated conductors in the plurality of insulated conductors, a center to center separation between the two insulated conductors is D, an average of diameters of the two insulated conductors is d, and D/d≥1.2. A separation between the first and second insulative layer portions varies by no more than about 20% along the length and width of the cable. For at least one pair of adjacent insulated conductors: an effective dielectric constant of the cable for the pair of insulated conductors driven with differential signals of equal amplitude and opposite polarities is less than about 2.2, and each of the insulated conductors has a propagation delay of less than about 4.75 nsec/meter as determined at data transfer speeds from about 1 Gbps to about 20 Gbps or as determined using time domain reflectometry using a signal rise time of 35 picoseconds.

BRIEF DESCRIPTION OF THE DRAWINGS

FIGS. 1-2A are schematic lateral cross-sectional views of ribbon cables;

FIGS. 12-14A are schematic top views of ribbon cables;

DETAILED DESCRIPTION

Figure 1:
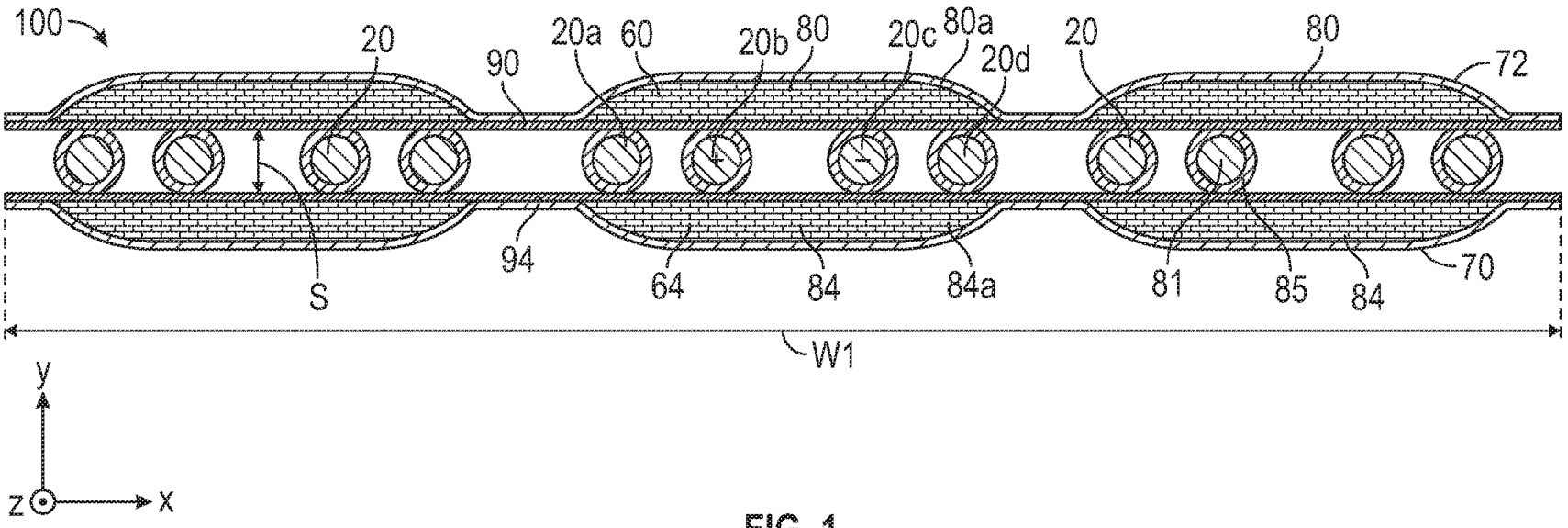

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

According to some aspects of the present description, ribbon cables incorporating materials or structures described herein have been found to provide improved performance over conventional cables. For example, the ribbon cables may have one or more of a reduced impedance variation along the cable length, lower skew, lower propagation delay, lower insertion loss, and improved bend performance compared to conventional cables. The materials or structures may have a low effective dielectric constant and/or a low dielectric loss (e.g., low effective loss tangent). For example, the materials or structures may have a high air (or other low dielectric constant material) content to provide the low effective dielectric constant. The ribbon cable may also have a high air content between signal conductors and between the signal and ground wires, for example. In some embodiments, the cable provides high resistance to deformation and related impedance changes despite the high air content. In some embodiments, the cable can be produced with high uniformity to maintain a constant impedance, and related data transmission performance along a single transmission path or among cables of the same design manufactured at different times. In some embodiments, the spacing between conductors (e.g., center-to-center spacing) in the cable can be different (e.g., smaller) than the spacing in a direction orthogonal to the plane of the conductors between the shields included in the cables. This can allow for a high density of conductors in the cable, for example, which is highly desirable in some cases.

In some embodiments, the conductors of the cable are insulated with a dielectric layer. In some embodiments, incorporating low effective dielectric constant materials or structures in the insulative layer(s) of the cable allows the thickness of the dielectric layer to be smaller than that of conventional cables while providing a desired cable impedance (e.g., a differential impedance in a range of 70 ohms to 110 ohms). For example, conventional cables typically have a ratio of a diameter of the insulated conductor to the diameter of the conductor of the insulated conductor substantially greater than 2 (e.g., about 2.8 or higher), while this ratio for cables of the present description having the same impedance can be less than about 2 in some embodiments.

The low effective dielectric constant materials or structures may be in insulative layers on each side of a plurality of substantially parallel conductors of the ribbon cable or in a single insulative layer wrapped around the plurality of conductors. The insulative layer(s) may have a low effective dielectric constant across the width of the cable or may have alternating lower and higher effective dielectric constant regions across the width of the cable. The insulative layer(s) may extend continuously or discontinuously along the length of the cable or may have portions (e.g., thicker portions or alternating high and low dielectric constant portions) that extend continuously or discontinuously along the length of the cable. The insulative layer(s) may have a low effective loss tangent.

FIG. 1 is a schematic lateral cross-sectional view of a ribbon cable 100 including a plurality of spaced apart conductors 20 and first and second insulative layers 60 and 64 disposed on opposite sides of the plurality of conductors 20. In some embodiments, the conductors 20 are substantially parallel and extend along a length (in the z-direction referring to the x-y-z coordinate system depicted in FIG. 1) of the cable 100. The conductors 20 are arranged along a width W1 of the cable 100. In some embodiments, the first and second insulative layers 60 and 64 are substantially coextensive with the plurality of conductors 20 along the length and width of the cable. In some embodiments, the first and second insulative layers 60 and 64 are adhered to the conductors 20. In some embodiments, one or both of the first and second insulative layers 60 and 64 is or comprises a polymer. The first insulative layer 60 includes alternating substantially parallel thicker and thinner portions 80 and 90 which may extend along the length of the cable 100, and the second insulative layer 64 includes alternating substantially parallel thicker and thinner portions 84 and 94 which may extend along the length of the cable 100. In some embodiments, the thicker portions 80 and 84 of the first and second insulative layers 60 and 64 are substantially aligned in one to one correspondence. In some embodiments, each corresponding thicker portion 80 and 84 of the first and second insulative layers 60 and 64, respectively, have at least one conductor in the plurality of conductors 20 disposed therebetween. For example, corresponding thicker portion 80*a* and 84*a* are aligned and have conductors 20*a*-20*d* disposed therebetween. In the illustrated embodiment, each of the conductors 20 includes a conductor 81 insulated with a dielectric layer 85. In other embodiments, at least some of the conductors 20 are uninsulated. The thicker portions 80 and 84 may include corrugated portions coextruded with the thinner portions 90 and 94, for example. Other suitable materials and methods for forming the thicker portions 80 and 84 are described further elsewhere herein.

In some embodiments, conductors 20*b* and 20*c* are signal wires and conductors 20*a* and 20*d* are ground wires. In some embodiments, the pair of adjacent conductors 20*b* and 20*c* can be driven with differential signals of equal amplitude and opposite polarities as schematically illustrated by the "+" and "−" signs on the conductors 20*b* and 20*c*. The space between the signal wires (e.g., conductors 20*b* and 20*c*) can be the same or different from the space between a ground wire and the adjacent signal wire (e.g., between conductor 20*a* and conductor 20*b* or between conductor 20*d* and conductor 20*c*). In some embodiments, the space between the signal wires is greater than the space between ground and adjacent signal wires. In other embodiments, the conductors are arranged in a coaxial configuration with a single signal wire between two adjacent ground wires. In some embodiments, coaxial (single conductor) and twin axial (differential) transmission lines are included in a single cable.

In some embodiments, the ribbon cable 100 includes first and second conductive shielding layers 70 and 72 disposed on opposite sides of and substantially coextensive with the respective first and second insulative layers 60 and 64 along the length and width of the cable 100. Each insulative layer 60 and 64 may be disposed between the conductors 20 and the shielding layer 72 and 70, respectively, corresponding to the insulative layer. In other words, insulative layer 60 may be disposed between the conductors 20 and the shielding layer 72, and insulative layer 64 may be disposed between the conductors 20 and the shielding layer 70. In some embodiments, the space between adjacent signal wires (e.g., conductors 20*b* and 20*c*) is different (e.g., smaller) than the space between the first and second conductive shielding layers 70 and 72 in the region between the signal wires. It has been found that cables of the present description can provide a specified impedance for a range of spacing between the signal wires and spacing between the first and second conductive shielding layers 70 and 72, in contrast to conventional cables. For example, a thinner overall cable can be provided for a given impedance by using a larger spacing between the signal wires. This can provide improved bendability of the cable for example. Alternatively, a higher density of wires (smaller spacing between adjacent wires) can be included in a thicker cable.

In some embodiments, the first and second shielding layers 70 and 72 substantially conform to the alternating thinner and thicker portions of the first and second insulative layers 60 and 64, respectively. A shielding layer may be described as substantially conforming to the alternating thinner and thicker portions of an insulative layer if it generally follows the shape of the alternating thinner and thicker portions. There may be some deviation in shape in regions of high curvature, for example. A shielding layer described as substantially conforming to the alternating thinner and thicker portions may conform or nominally conform to the alternating thinner and thicker portions.

In some embodiments, a distance between the conductive shielding layers 70 and 72 and a ground wire (e.g., conductor 20*a* or 20*d*) is reduced by including the thinner portions 90 and 94. In some embodiments, a shortest distance between a ground wire and a shielding layer (e.g., shielding layer 70 or 72) is less than a shortest distance between a signal wire (e.g., conductor 20*b* or 20*c*) and the shielding layer. In some embodiments, a shortest distance between a ground wire and at least one of the shielding layers 70 and 72 is less than about 100 micrometers.

In some embodiments, the first and second insulative layers 60 and 64 may be described as surrounding the plurality of conductors 20. As used herein, surrounding includes completely surrounding or surrounding at least 80 percent of a perimeter of the plurality of conductors in each lateral cross-section along at least 80 percent of the length of the conductors 20. In some embodiments, the first and second insulative layers 60 and 64 are pinched together at opposing edges along the width of the cable 100 (see, e.g., FIG. 2A). The first and second insulative layers 60 and 64 may then be considered to be portions of an insulative layer completely surrounding the plurality of conductors 20. The insulative layer may be described as completely surrounding the conductors 20 if the insulative layer completely surrounds the conductors 20 in each lateral cross-section along at least 90 percent of the length of the conductors 20. It will be understood that the insulative layer may be stripped from end portions of the cable in order to expose the conductors 20 for attachment with an electronic device so that the insulative layer may not be present at the longitudinal ends, for example, of the conductors 20.

In some embodiments, the effective dielectric constants of the thicker portions 80 and 84 are lower than effective dielectric constants of the thinner portions 90 and 94. In some embodiments, the effective dielectric constants of the thicker portions 80 and 84 are substantially equal to than effective dielectric constants of the thinner portions 90 and 94. The effective dielectric constants can be understood to be substantially equal if they are within 10 percent of each other. The effective dielectric constants of the thicker portions 80 and/or 84 can be lowered by including air or other dielectric constant materials in the thicker portions. For example, the thicker portions may be porous with air in the voids. In some embodiments, the thinner portions may also have a low effective dielectric constant due to including a high content of air or other low dielectric constant material (e.g., the thinner portions may be porous). As another example, the thicker portions may be structured, as described further elsewhere herein, with air and/or a low dielectric constant material disposed in the structures. It has been found that utilizing thicker portions having a relatively low effective dielectric constant can result in reduced effective dielectric constant of the cable, reduced propagation delay, reduced skew, and reduced dielectric loss, for example.

In some embodiments, each of the thicker portions 80 and 84 has an effective dielectric constant of less than about 2, or less than about 1.8, or less than about 1.6, or less than about 1.5, or less than about 1.4, or less than about 1.3, or less than about 1.2.

In some embodiments, an effective dielectric constant of the cable for at least one pair of adjacent conductors driven with differential signals of equal amplitude and opposite polarities is less than about 2.5, or less than about 2.2, or less than about 2, or less than 1.8, or less than about 1.6, or less than about 1.5, or less than about 1.4, or less than about 1.3, or less than about 1.2.

Propagation delay and skew are additional electrical characteristics of electrical cables. Propagation delay depends on the effective dielectric constant of the cable and is the amount of time that it takes for a signal to travel from one end of the cable to the opposite end of the cable. The propagation delay of the cable may be an important consideration in system timing analysis. The effective dielectric constant of a cable refers to the square of the ratio of the speed of light in a vacuum to the propagation speed of signals in the cable and is determined by the materials that are in the propagation volume of the electric field propagating in the cable, the geometric arrangement of the materials in the electric field, and the geometric distribution of the electric field itself. The effective dielectric constant of a cable for a pair of adjacent insulated conductors can be measured by driving the pair of insulated conductors with differential signals of equal amplitude and opposite polarities and determining a propagation delay time per unit length of the cable utilizing time domain reflectometry or time domain transmission, for example. The effective dielectric constant of the cable is then given by the speed of light in a vacuum squared times the square of the propagation delay time per unit length. The effective dielectric constant can be determined at a specified data transfer rate or range of data transfer rates (e.g., the effective dielectric constant may be less than a specified value throughout a range of data transfer rates), at a specified frequency or range of frequencies, or using time domain reflectometry at a specified signal rise time or range of signal rise times. Except where specified differently, the effective dielectric constant, propagation delay, and/or skew of a cable can be understood to be the effective dielectric constant, propagation delay, and/or skew, respectively, determined using time domain reflectometry using a signal rise time of 35 picoseconds to determine the propagation delay time per unit length.

The effective dielectric constant of a composite containing more than one material is a bulk property of the composite which depends on the dielectric constants of the materials in the composite and on the geometric arrangement of the materials. The effective dielectric constant of a composite can be estimated as the volume-weighted average of the dielectric constants of the materials in the composite. For example, in some cases, the composite includes air and one other material having a dielectric constant of $\varepsilon_1$. Approximating the dielectric constant of air as 1 and taking the volume fraction of air to be f, the effective dielectric constant of the composite is then given approximately by $\varepsilon_{eff} \approx f+(1-f)\varepsilon_1$. In other cases, the composite includes more than two materials, one of which may (or may not) be air. The effective dielectric constant of a material which is not a composite refers to the actual dielectric constant of the material. The effective dielectric constant of an insulative layer or a portion of an insulative layer, refers to the effective dielectric constant of the composite or the material making up the insulative layer or the portion of the insulative layer.

Any of the dielectric constants described herein may be evaluated at a frequency of 1 MHz, or 100 MHz, or 1 GHz, or 20 GHz, or in a range of 1 GHz-20 GHz, or at the fundamental frequency of a driving signal applied to the cable, or at a frequency between the fundamental frequency and the third order harmonic of the fundamental frequency, for example. Comparisons of dielectric constants or effective dielectric constants of different materials or structures or cables can be taken to be at a same frequency (e.g., 20 GHz) unless indicated otherwise. Any of the dielectric constants or effective dielectric constants described herein may be greater than 1, or greater than 1.01, or greater than 1.03, or greater than 1.05.

In some embodiments, at least one conductor in the plurality of conductors 20 is insulated with a dielectric material having a dielectric constant of at least W, and an effective dielectric constant of the cable for a pair of adjacent conductors that includes the at least one insulated conductor driven with differential signals of equal amplitude and opposite polarities is less than about 0.8 times W, or less than about 0.7 times W, or less than about 0.6 times W, or less than about 0.5 times W, or less than about 0.4 times W, or less than about 0.3 times W. In some embodiments, W is about 2.8, or about 3, or about 3.2, or about 3.4, or about 3.6, or about 3.8, or about 4. In some embodiments, at least one conductor in the plurality of conductors 20 is insulated with a dielectric material having a dielectric constant greater than about 2.5, or greater than about 2.8, or greater than about 3.2, or greater than about 3.6, or greater than about 3.8, or greater than about 4, and an effective dielectric constant of the cable for a pair of adjacent conductors that includes the at least one insulated conductor driven with differential signals of equal amplitude and opposite polarities is less than about 2.5, or less than about 2.2, or less than about 2, or less than about 1.8, or less than about 1.7, or less than about 1.6, or less than about 1.5, or less than about 1.4, or less than about 1.3, or less than about 1.2. In some embodiments, each conductor in the plurality of conductors 20 is insulated. In some embodiments, the at least one conductor in the plurality of conductors 20 insulated with a dielectric material having a dielectric constant of at least W is each conductor in the plurality of conductors 20. Other cables described herein (e.g., those depicted in any of FIGS. 2A, 3A-3B, 5-6, and 9-14) may also have an effective dielectric constant in any of the above ranges when the conductors are insulated with a material having a dielectric constant in any of the above ranges.

In some embodiments, at least one conductor in the plurality of conductors 20 has a propagation delay of less than about 4.75 nsec/meter, or less than about 4.5 nsec/meter, or less than about 4.25 nsec/meter, or less than about 4 nsec/meter, or less than about 3.75 nsec/meter at data transfer speeds from about 1 Gbps to about 20 Gbps. For example, the propagation delay may be less than about 4.75 nsec/meter for data transfer speeds throughout the range from about 1 Gbps to about 20 Gbps. In some embodiments, at least one conductor in the plurality of conductors 20 has a propagation delay of less than about 4.75 nsec/meter at data transfer speeds from about 1 Gbps to about 20 Gbps, or from about 1 Gbps to about 50 Gbps, or from about 1 Gbps to about 75 Gbps, or from about 1 Gbps to about 100 Gbps. In some embodiments, at least one conductor in the plurality of conductors 20 has a propagation delay of less than about 4.75 nsec/meter as determined using time domain reflectometry using a signal rise time of 35 picoseconds. Any of the cables of the present description may have at least one conductor in the plurality of conductors having a propagation delay of less than about 4.75 nsec/meter, or less than about 4.5 nsec/meter, or less than about 4.25 nsec/meter, or less than about 4 nsec/meter, or less than about 3.75 nsec/meter at data transfer speeds from about 1 Gbps to about 20 Gbps, or from about 1 Gbps to about 50 Gbps, or from about 1 Gbps to about 75 Gbps, or from about 1 Gbps to about 100 Gbps. Any of the cables of the present description may have at least one conductor in the plurality of conductors having a propagation delay of less than about 4.75 nsec/meter, or less than about 4.5 nsec/meter, or less than about 4.25 nsec/meter, or less than about 4 nsec/meter, or less than about 3.75 nsec/meter as determined using time domain reflectometry using a signal rise time of 35 picoseconds.

The difference in propagation delay between two or more conductors in a cable is referred to as skew. Low skew is generally desirable between conductors of a cable used in single ended circuit arrangements and between conductors used as a differential pair. Skew between multiple conductors of a cable used in single ended circuit arrangements can affect overall system timing. Skew between two conductors used in a differential pair circuit arrangement is also a consideration. For example, conductors of a differential pair that have different lengths can result in skew between the signals of the differential pairs. Differential pair skew can increase insertion loss, impedance mismatch, and/or crosstalk, and/or can result in a higher bit error rate and jitter. Skew produces conversion of the differential signal to a common mode signal that can be reflected back to the source, reduces the transmitted signal strength, creates electromagnetic radiation, and can dramatically increase the bit error rate, in particular jitter. Ideally, a pair of transmission lines will have no skew, but, depending on the intended application, a differential S-parameter SCD21 or SCD12 value (representing the differential-to common mode conversion from one end of the transmission line to the other) of less than −18 to −30 dB up to a frequency of interest, such as, e.g., 6 GHz, may be acceptable. In some embodiments of the present description, a ribbon cable has a resonance-free insertion loss up to at least 20 GHz where a resonance refers to a dip of at least 10 dB.

Skew of a cable can be expressed as a difference in propagation delay per meter for the conductors in a cable per unit length. Intrapair skew is the skew within a differential pair and interpair skew is the skew between two pairs. There is also skew for two single coax or other even unshielded wires. Cables described herein may achieve skew values of less than about 20 psec/meter, or less than about 15 psec/meter, or less than about 10 psec/meter, or less than about 5 psec/meter, at data transfer speeds from about 1 Gbps to about 20 Gbps, or from about 1 Gbps to about 50 Gbps, or from about 1 Gbps to about 75 Gbps, or from about 1 Gbps to about 100 Gbps. Cables described herein may achieve skew values of less than about 20 psec/meter, or less than about 15 psec/meter, or less than about 10 psec/meter, or less than about 5 psec/meter, as determined using time domain reflectometry using a signal rise time of 35 picoseconds.

The conductors may include any suitable conductive material, such as an elemental metal or a metal alloy (e.g., copper or a copper alloy), and may have a variety of cross sectional shapes and sizes. For example, in cross section, the conductors may be circular, oval, rectangular or any other shape. One or more conductors in a cable may have one shape and/or size that differs from other one or more conductors in the cable. The conductors may be solid or stranded wires. All the conductors in a cable may be stranded, all may be solid, or some may be stranded and some solid. Stranded conductors and/or ground wires may take on different sizes and/or shapes. The conductors may be coated or plated with various metals and/or metallic materials, including gold, silver, tin, and/or other materials.

The material used to insulate the conductors of the conductor sets may be any suitable material that achieves the desired electrical properties of the cable. In some cases, the insulation used may be a foamed insulation which includes air to reduce the dielectric constant and the overall thickness of the cable. One or both of the shielding films may include a conductive layer (e.g., a metal foil) and a non-conductive polymeric layer. The conductive layer may include any suitable conductive material, including but not limited to copper, silver, aluminum, gold, and alloys thereof. The non-conductive polymeric layer may be an electromagnetic interference (EMI) absorbing layer. For example, the non-conductive polymeric layer may include EMI absorbing filler material (e.g., ferrite materials). Alternatively, or in addition, in some embodiments, one or more separate EMI absorbing layers are included. The shielding films may have a thickness in the range of 0.01 mm to 0.05 mm and the overall thickness of the cable may be less than 2 mm or less than 1 mm.

Figure 2A:
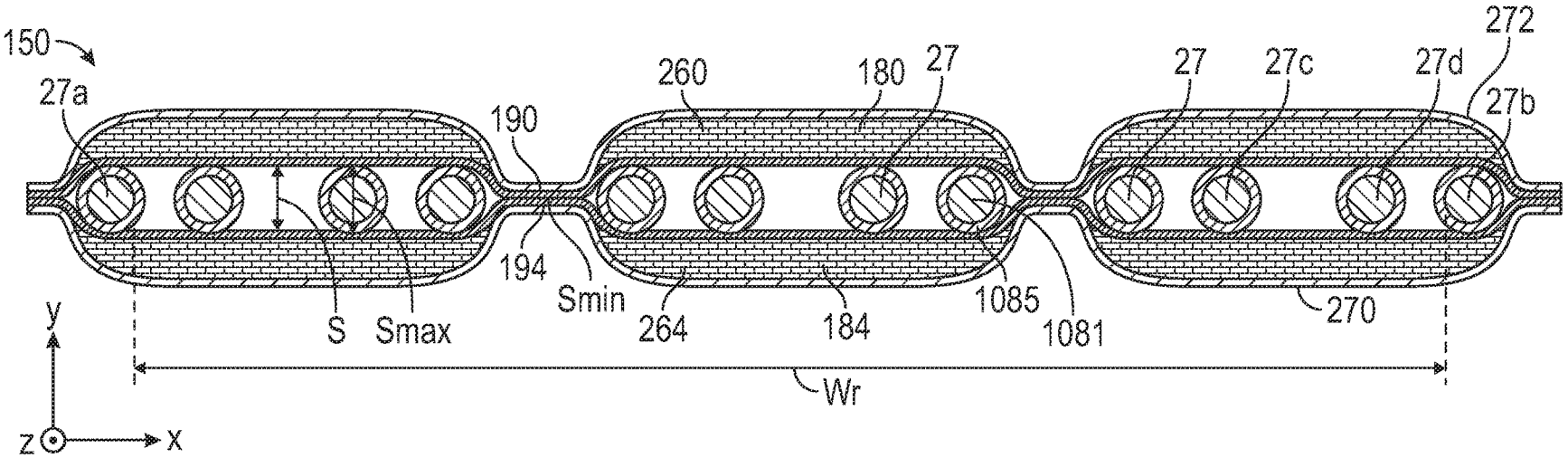

The separation between the first and second insulative layers may be constant or approximately constant across the width of the cable, or the separation may vary. FIG. 2A is a schematic lateral cross-sectional view of a ribbon cable 150 including a plurality of spaced apart conductors 27 and first and second insulative layers 260 and 264 disposed on opposite sides of the plurality of conductors 27. The conductors 27 are insulated in the illustrated embodiment and include a central conductor 1081 and a dielectric layer 1085. In other embodiments, uninsulated conductors may be included. The first insulative layer 260 includes alternating substantially parallel thicker and thinner portions 180 and 190 which may extend along the length of the cable 150, and the second insulative layer 264 includes alternating substantially parallel thicker and thinner portions 184 and 194 which may extend along the length of the cable 150. The ribbon cable 150 also includes first and second conductive shielding layers 270 and 272 disposed on opposite sides of and substantially coextensive with the respective first and second insulative layers 260 and 264 along the length and width of the cable 210. Cable 150 may be similar to cable 100 except for the separation S between the first and second insulative layers which is variable for cable 150 and may be constant or approximately constant for cable 100. In the cross-section depicted in FIG. 2A, the separation S between the first and second insulative layers 260 and 264 varies from Smax to Smin across a width Wr of a region between two end conductors 27*a* and 27*b* in the plurality of conductors. In some embodiments, Smin is zero or approximately zero. In other embodiments, Smin is the same or approximately the same as Smax. In some embodiments, in at least one transverse cross-section of the cable, a difference ((Smax−Smin)/Smax times 100%) between maximum Smax and minimum Smin separations between the first and second insulative layers across a width of a region between two end conductors in the plurality of conductors is less than about 20%, or less than about 10%, or less than about 5%. A small or zero Smin can be chosen to reduce a shortest distance between a ground wire and one or both of the conductive shielding layers 270 and 272. A zero Smin can also be used so that the cable can be cut apart and separated along the pinches where Smin is zero, which may be desired for some applications.

An element (e.g., an insulative layer, thicker and thinner portions of an insulative layer, insulated conductors, etc.) may be said to extend along a length or a width if it extends over at least a majority of the length or width, respectively. An element described as extending along a length or a width may extend over at least about 60%, or at least about 70%, or at least about 80%, or at least about 90%, or at least about 95%, or 100% of the length or width, respectively. Elements may be described as substantially coextensive along a length or a width or both if the elements extend along at least a majority of the lengths or widths or both, respectively, of each other. Elements described as substantially coextensive over a length and/or a width may extend along at least about 60%, or at least about 70%, or at least about 80%, or at least about 90%, or at least about 95%, or 100% of the lengths and/or widths of each other.

Figure 2B:
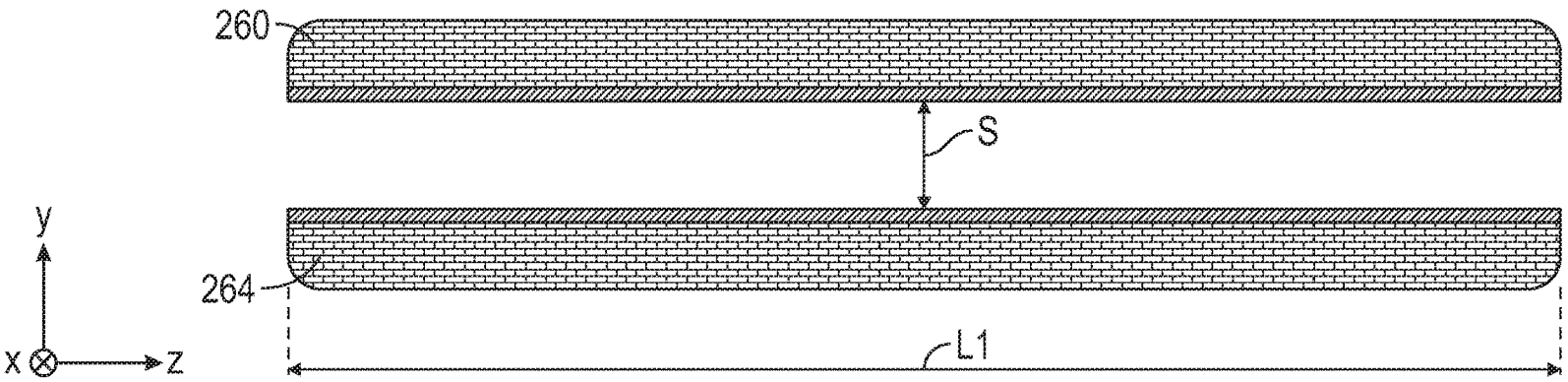
FIG. 2B is a schematic longitudinal cross-sectional view of insulative layers of FIG. 2A.

FIG. 2B is a schematic view of the first and second insulative layers 260 and 264 in a longitudinal cross-section at a location between two adjacent conductors. As illustrated in FIG. 2B, in some embodiments, for at least one cable location between two adjacent conductors 27*c* and 27*d* in the plurality of conductors 27, a separation S between the first and second insulative layers 260 and 264 is constant or approximately constant along the length L1 of the first and second insulative layers 260 and 264 which may be approximately the length of the cable. In some embodiments, for at least one cable location between two adjacent conductors 27*c* and 27*d* in the plurality of conductors 27, a separation S between the first and second insulative layers 260 and 264 varies by no more than about 20%, or no more than about 10%, or no more than about 5% along the length of the cable.

In some embodiments, in at least one transverse cross-section of a cable including plurality of conductors and an insulative layer(s), at least one insulative layer includes a plurality of structures, each conductor in the plurality of conductors disposed on and aligned with a structure in the plurality of structures.

Figure 3A:
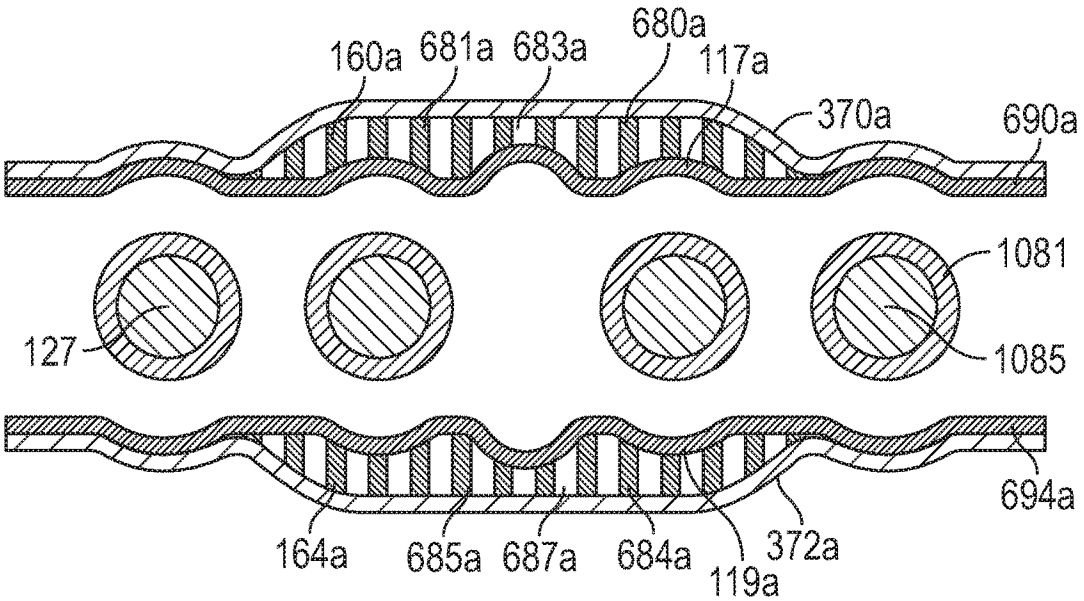
FIGS. 3A-3B are exploded cross-sectional views of ribbon cables.
Figure 3B:
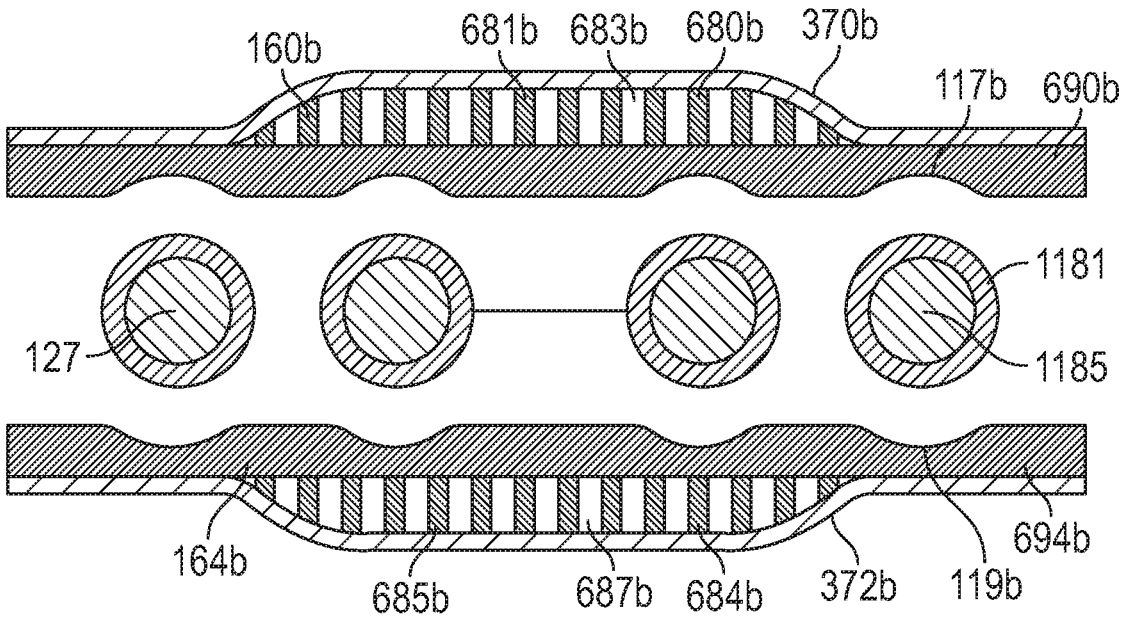

FIGS. 3A-3B are schematic exploded cross-sectional views of portions of electrical cables. In the embodiment illustrated in FIG. 3A, a plurality of spaced apart conductors 127 are disposed between first and second insulative layers 160*a* and 164*a*. First and second conductive shielding layers 370*a* and 372*a*, and 370*b* and 372*b*, disposed on opposite sides of the respective first and second insulative layers are also included. Insulative layer 160*a* includes a plurality of structures 117*a* such that each conductor in the plurality of conductors 127 is disposed on and aligned with a structure in the plurality of structures 117*a*, and insulative layer 164*a* includes a plurality of structures 119*a* such that each conductor in the plurality of conductors 127 is disposed on and aligned with a structure in the plurality of structures 119*a*. In the embodiment illustrated in FIG. 3B, the plurality of spaced apart conductors 127 are disposed between first and second insulative layers 160*b* and 164*b*. Insulative layer 160*b* includes a plurality of structures 117*b* such that each conductor in the plurality of conductors 127 is disposed on and aligned with a structure in the plurality of structures 117*b*, and insulative layer 164*b* includes a plurality of structures 119*b* such that each conductor in the plurality of conductors 127 is disposed on and aligned with a structure in the plurality of structures 119*b*. In the embodiment illustrated in FIG. 3A, the first and second insulative layers 160*a* and 164*a* are shaped to provide the structures 117*a* and 119*a*. In the embodiment illustrated in FIG. 3B, one surface, but not the opposing surface, of the first and second insulative layers 160*b* and 164*b* are structured to provide the structures 117*b* and 119*b*. The conductors 127 include a central conductor 1185 and a dielectric layer 1181.

In other embodiments, one, but not the other, of the first and second insulative layers includes structures such that each conductor in the plurality of conductors is disposed on and aligned with a structure. In still other embodiments, each of the first and second insulative layers have an unstructured major surface upon which the plurality of conductors is disposed. For example, in the transverse cross-section of cable 100 illustrated in FIG. 1, each of the conductors 20 is disposed on an unstructured major surface of the first insulative layer 60 and on an unstructured major surface of the second insulative layer 64. Other examples where the first and second insulative layers have an unstructured major surface upon which the plurality of conductors is disposed are illustrated in FIGS. 9-11C.

In the embodiment illustrated in FIG. 3A, the thicker portion 680*a* of the first insulative layer 160*a* includes a plurality of alternating higher dielectric constant regions 681*a* and lower dielectric constant regions 683*a*, and the thicker portion 684*a* of the second insulative layer 164*a* includes a plurality of alternating higher dielectric constant regions 685*a* and lower dielectric constant regions 687*a*. Similarly, in the embodiment illustrated in FIG. 3B, the thicker portion 680*b* of the first insulative layer 160*b* includes a plurality of alternating higher dielectric constant regions 681*b* and lower dielectric constant regions 683*b*, and the thicker portion 684*b* of the second insulative layer 164*b* includes a plurality of alternating higher dielectric constant regions 685*b* and lower dielectric constant regions 687*b*. In some embodiments, the alternating higher dielectric constant regions and lower dielectric constant regions extend continuously along the length of the cable (see, e.g., FIG. 12) or extend discontinuously along the length of the cable (see, e.g., FIG. 13) as described further elsewhere herein.

In some embodiments, the thinner portions 690*a* or 690*b* of the first insulative layer 160*a* or 160*b*, respectively, is made of the same material as the higher dielectric constant regions 681*a* or 681*b*, respectively. In some embodiments, the thinner portions 694*a* or 694*b* of the second insulative layer 164*a* or 164*b*, respectively, is made of the same material as the higher dielectric constant regions 685*a* or 685*b*, respectively. In some embodiments, the effective dielectric constant of the thinner portions 690*a* or 690*b* of the first insulative layer 160*a* or 160*b*, respectively, is substantially equal to the dielectric constant of the higher dielectric constant regions 681*a* or 681*b*, respectively. In some embodiments, the effective dielectric constant of the thinner portions 694*a* or 694*b* of the second insulative layer 164*a* or 164*b*, respectively, is substantially equal to the dielectric constant of the higher dielectric constant regions 685*a* or 685*b*, respectively.

In some embodiments, the thicker portions are separated from each other so that they are not part of an insulative layer that is continuous across a width of a cable in at least one transverse cross-section. The thicker portions may be non-conductive structured layers that extend across a width of a set of the conductors and along a length of the set of conductors. The conductor set and the non-conductive structured layers may be wrapped with a conductive shielding layer. Additional insulative layers may be disposed on opposite sides of the shielding layer.

Figure 4:
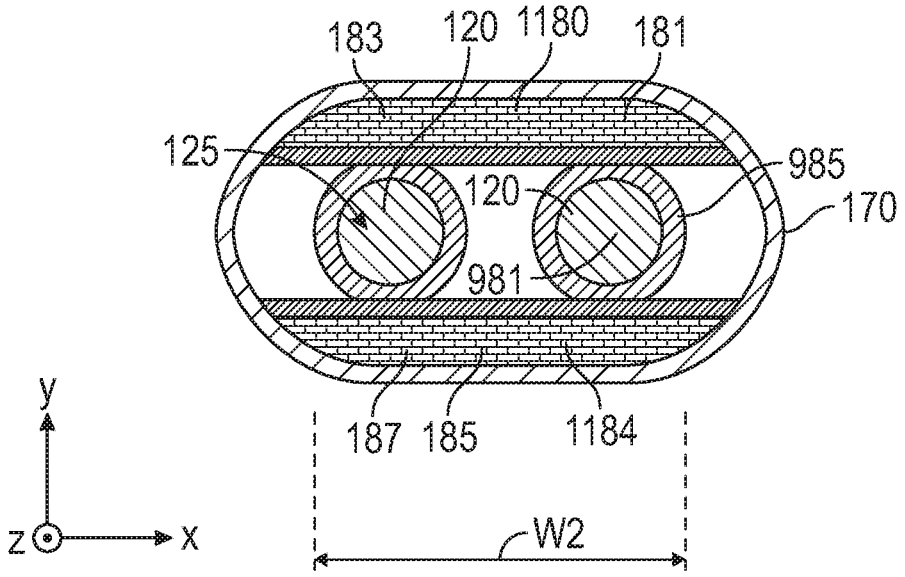
FIG. 4 is a schematic cross-sectional view of a conductor set.

FIG. 4 is a schematic lateral cross-sectional view of a conductor set 125 including a plurality of spaced apart conductors 120 which are arranged along a width W2 of the conductor set 125 and may be substantially parallel and extend along a length (in the z-direction of the figure) of the conductor set 125. The conductor set 125 includes first and second non-conductive structured layers 1180 and 1184 disposed on opposite sides of the conductors 120. In some embodiments, the non-conductive structured layers 1180 and 1184 are substantially coextensive with the plurality of conductors 120 along the length and width of the conductor set 125. Each structured layer 1180 and 1184 may be adhered to the conductors 120. The structured layers 1180 and 1184 include a plurality of higher dielectric constant regions 181 and 185, respectively, defining a plurality of lower dielectric constant regions 183 and 187, respectively, therebetween. A conductive shielding layer 170 is wrapped around the first and second non-conductive structured layers 1180 and 1184.

In the illustrated embodiments, the conductors 120 are insulated and include a central conductor 981 and a dielectric layer 985.

Figure 5:
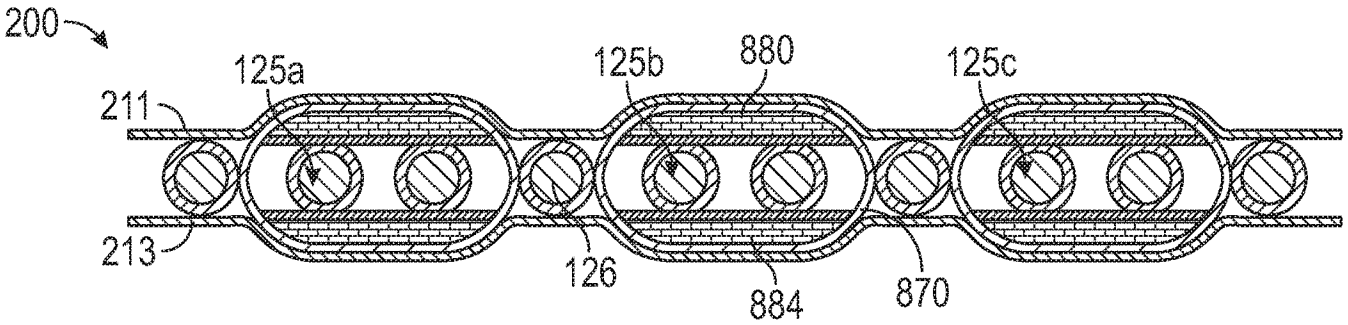
FIGS. 5-6 are schematic cross-sectional views of ribbon cables.

FIG. 5 is a schematic lateral cross-sectional view of a shielded ribbon cable 200 which includes a plurality of spaced apart substantially parallel conductor sets 125*a*, 125*b* and 125*c* arranged along a width of the cable 200. Each of the conductor sets 125*a*-125*c* may be as described for conductor set 125. For example, structured layers 880 and 884 may be as described for structured layers 1180 and 1184 and shielding layer 870 may be as described for shielding layer 170. Cable 200 includes first and second insulative layers 211 and 213 disposed on opposite sides of the plurality of conductor sets. In some embodiments, the first and second insulative layers 211 and 213 are substantially coextensive with the plurality of conductor sets along the length and width of the cable 200. In the illustrated embodiment, the cable 200 includes additional insulated conductors 126 which are not part of the conductor sets having non-conductive structured layers wrapped with a conductive shielding layer.

Figure 6:
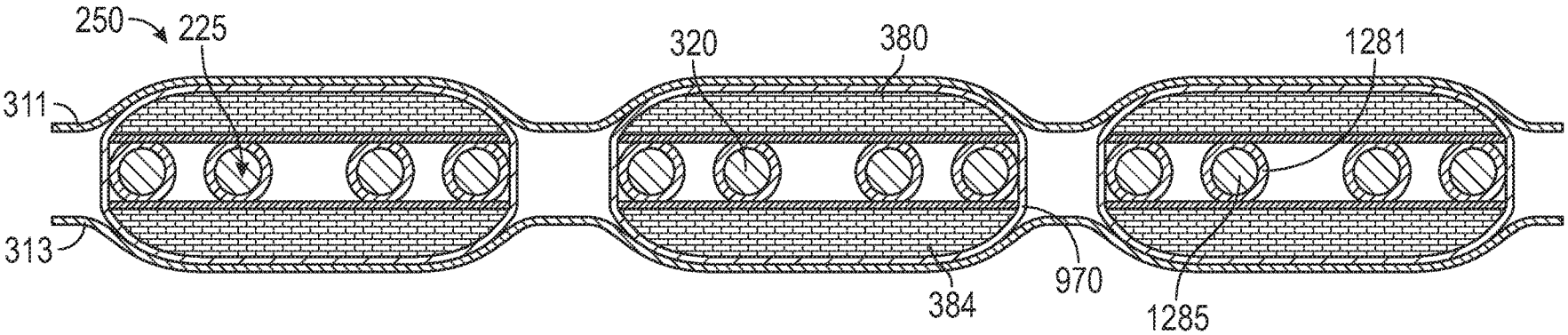

FIG. 6 is a is a schematic lateral cross-sectional view of a shielded ribbon cable 250 which includes a plurality of spaced apart substantially parallel conductor sets 225, arranged along a width of the cable 250. Each of the conductor sets 225 includes a plurality of conductors 320 and first and second non-conductive structured layers 380 and 384 disposed on opposite sides of the plurality of conductors 320. The conductor sets 225 may be as described for conductor set 125 except for the number of conductors 120. For example, structured layers 380 and 384 may be as described for structured layers 1180 and 1184 and shielding layer 970 may be as described for shielding layer 170. The cable 250 further includes first and second insulative layers 311 and 313 disposed on opposite sides of the plurality of conductor sets 225. The conductors 320 include a central conductor 1285 insulated with a dielectric layer 1281.

Figure 7A:
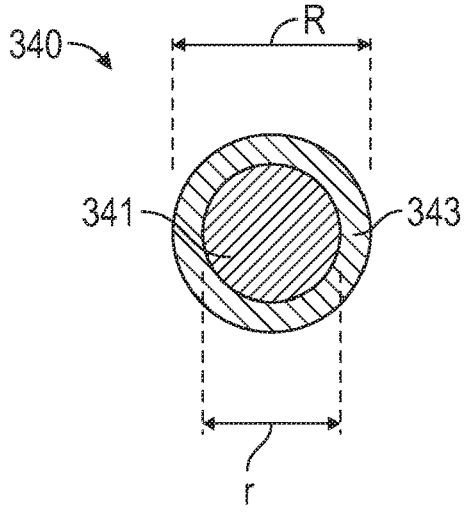
FIG. 7A is a schematic cross-sectional view of an insulated conductor.
Figure 7B:
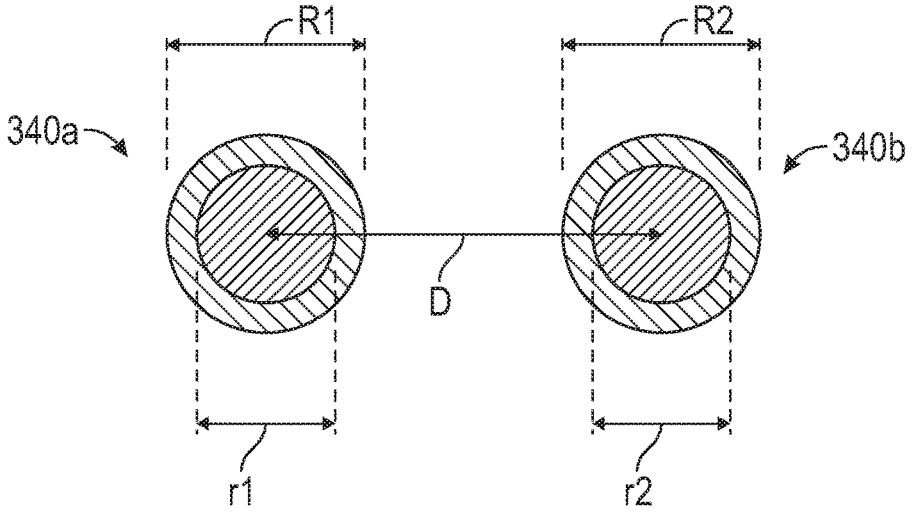
FIG. 7B is a schematic cross-sectional view of a pair of adjacent insulated conductors.

In some embodiments, a ribbon cable includes a plurality of substantially parallel insulated conductors extending along a length of the cable and arranged along a width of the cable, and includes an insulative layer surrounding and adhered to the plurality of the insulated conductors. The insulative layer may be a single layer or may include first and second insulative layers disposed on opposite sides of the cable. The first and second insulative layers may be substantially coextensive with the plurality of insulated conductors along the length and width of the cable. In some embodiments, each insulated conductor has a diameter R, and the conductor of the insulated conductor has a diameter r as illustrated in FIG. 7A which is a schematic cross-sectional view of insulated conductor 340 including conductor 341 insulated with dielectric material 343. In some embodiments, for each pair of adjacent insulated conductors in the plurality of insulated conductors, a center to center separation between the two insulated conductors is D as illustrated in FIG. 7B which is a schematic cross-sectional view of adjacent insulated conductors 340*a* and 340*b*. Insulated conductor 340*a* has a diameter R1, and the conductor of the insulated conductor 340*a* has a diameter r1. Insulated conductor 340*b* has a diameter R2, and the conductor of the insulated conductor 340*b* has a diameter r2. In some embodiments, R1 and R2 are equal or about equal, and in some embodiments, r1 and r2 are equal or about equal. In other embodiments, differing sizes of conductors or insulated conductors are utilized in a same cable. An average diameter of the two insulated conductors in the pair is d=½ (R1+R2).

In the embodiment illustrated in FIG. 7A, the dielectric material 343 has a thickness of ½ (R−r). In some embodiments, each insulated conductor is insulated with a dielectric material having a thickness greater than or equal to zero. In some embodiments, the thickness of the dielectric material is greater than 0, or greater than 10 micrometers, or greater than 20 micrometers, or greater than 30 micrometers. In some embodiments, the thickness of the dielectric material is less than 400 micrometers, or less than 300 micrometers, or less than 200 micrometers, or less than 100 micrometers. In some embodiments, each insulated conductor is insulated with a dielectric material having a thickness greater than zero so that R is greater than r. When a property of the dielectric material (e.g., dielectric constant or material type) is specified, the thickness of the dielectric material can be understood to be greater than zero. In some embodiments, R/r is greater than 1 and less than about 4. In some embodiments, R/r is less than about 4, or less than about 3.5, or less than about 3, or less than about 2.5, or less than about 2, or less than about 1.5. In some embodiments, D/d is greater than or equal to 1.05, or greater than or equal to 1.10, or greater than or equal to 1.15, or greater than or equal to 1.2, or greater than or equal to 1.3, or greater than or equal to 1.4. In some embodiments, each insulated conductor in a cable has a same diameter. In other embodiments, insulated conductors with two or more diameters are used. For example, larger ground wires may be used in order to decrease a shortest distance from the ground wire to a conductive shielding layer. The spacing between adjacent pairs of conductors may be the same or may be different. For example, the spacing between adjacent signal wires may be greater than the spacing between adjacent signal and ground wires.

Any suitable material can be used for the dielectric material 343. For example, in some embodiments, the dielectric material (e.g., 343) of at least one insulated conductor in a cable includes one or more of a polyolefin, a solid polyolefin, a foamed polyolefin, a polyimide, a polyamide, a polytetrafluoroethylene (PTFE), a polyester, a polyurethane, polyester-imide, polyamide-imide, and a fluoropolymer.

In some embodiments, a ribbon cable includes a plurality of spaced apart insulated conductors which may be substantially parallel extending along a length of the cable and arranged along a width of the cable, and an insulative layer surrounding and adhered to the plurality of the insulated conductors. For example, the insulative layer may include first and second insulative layers on opposite sides of the plurality of insulative conductors, each having a structured or unstructured major surface which may be adhered to the insulated conductors. The insulative layer may be indirectly adhered to the plurality of the insulated conductors. For example, the plurality of insulated conductors may be arranged into sets of conductors surrounded by a conductive shielding layer which may be bonded to structured non-conducive layers that are bonded to insulated conductor in the conductor set, and the insulative layer may be bonded to the conductive shielding layers. FIGS. 8A-8E schematically illustrate various exemplary ways of adhering a conductor to an insulative layer(s). The insulative layer(s), or portions of insulative layer(s), schematically illustrated in FIGS. 8A-8E do not show thicker portions or alternating high and low dielectric constant portions, but it will be understood that such portions can be included in the insulative layer(s) as described further elsewhere herein.

Figure 8A:
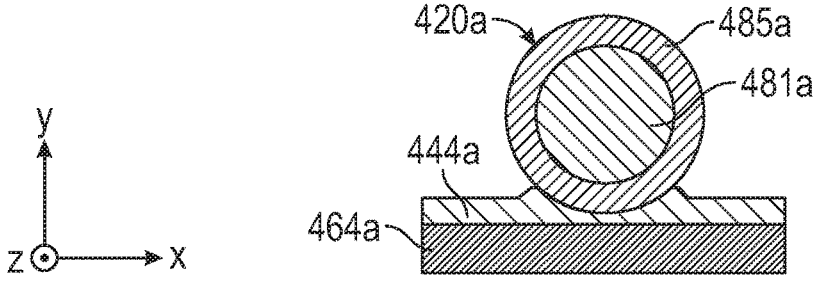
FIG. 8A is a schematic cross-sectional view of an insulated conductor bonded to an insulative layer.

FIG. 8A is a schematic cross-sectional view of an insulated conductor 420*a* bonded to an insulative layer 464*a* through a bonding layer 444*a*. Insulated conductor 420*a* includes a conductor 481*a* and an insulation material 485*a* surrounding and insulating the conductor 481*a*. In the illustrated embodiment, the boding layer 444*a* is deformed to partially conform to the outer surface of the insulated conductor 420*a*. Insulative layer 464*a* is illustrated as bonded to a bottom surface of insulated conductor 420*a*. It will be understood than an opposing insulative layer may be similarly bonded to the top surface of insulated conductor 420*a*. Similarly, for the embodiments illustrated in FIGS. 8C-8E an opposing insulative layer may be bonded to the top surface of the insulated conductor using the same boding technique (or optionally using a different technique) used for bonding the bottom surface of the insulated conductor to an insulative layer.

Figure 8B:
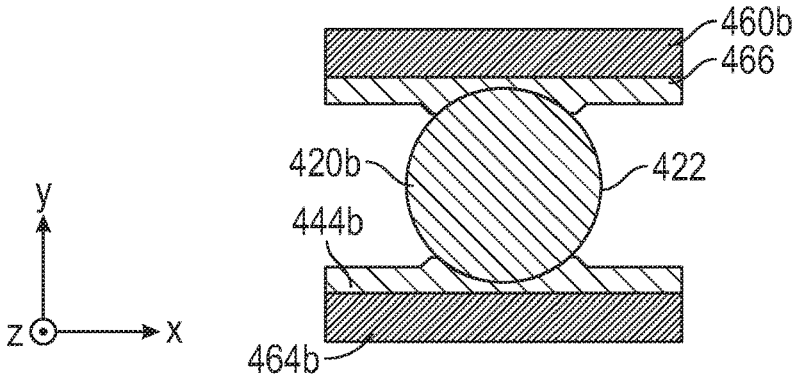
FIG. 8B is a schematic cross-sectional view of a conductor bonded to two insulative layers.

In some embodiments, at least one conductor is uninsulated along the length of the cable. In some embodiments, the at least one uninsulated conductor is adhered to the first and second insulative layers via one or more adhesive layers. The one or more adhesive layers may cover only portions of an outermost surface of the at least one uninsulated conductor. In some embodiments, the one or more adhesive layers covers at least portions of a top surface of the at least one uninsulated conductor and at least portions of a bottom surface of the at least one uninsulated conductor. FIG. 8B is a schematic cross-sectional view of an uninsulated conductor 420*b* bonded to a first insulative layer 460 through an adhesive layer 466 and bonded to a second insulative layer 464*a* through bonding layer 444*a*. The adhesive layer 466 covers only a top portion of the outermost surface 422 of the uninsulated conductor 420*b* and the adhesive layer 444*b* covers only a bottom portion of the outermost surface 422 of the uninsulated conductor 420*b*.

Figure 8C:
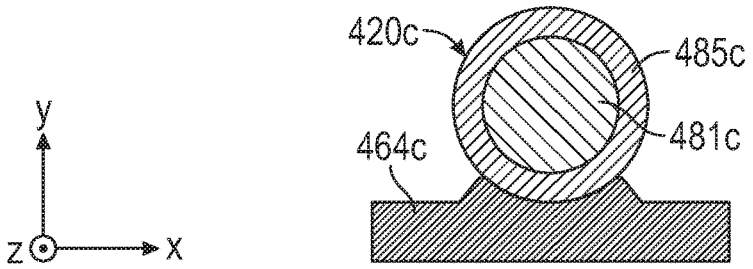
FIGS. 8C-8E are schematic cross-sectional views of conductors bonded to insulative layers.

In some embodiments, a conductor is bonded to an insulative layer without using an adhesive. FIG. 8C is a schematic cross-sectional view of an insulated conductor 420*c* bonded to an insulative layer 464*c*. Insulated conductor 420*c* includes a conductor 481*c* and an insulation material 485*c* surrounding and insulating the conductor 481*c*. In some embodiments, an uninsulated conductor is similarly bonded to an insulative layer without a bonding layer. The bonding can result from applying one or both of heat and pressure to insulative layer 464*c* in contact with the insulated conductor 420*c*. In some embodiments, one or both of the insulative layer and the insulation material of the insulated conductor soften and deforms under heat and/or pressure to provide bonding. In the embodiment illustrated in FIG. 8C, the insulative layer 464*c* is deformed to partially conform to the outer surface of the insulated conductor 420*c*.

Figure 8D:
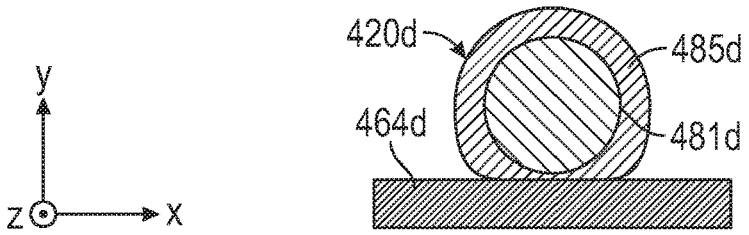

FIG. 8D is a schematic cross-sectional view of an insulated conductor 420*d* bonded to an insulative layer 464*d*. Insulated conductor 420*d* includes a conductor 481*d* and an insulation material 485*d* surrounding and insulating the conductor 481*d*. In the illustrated embodiment, the insulation material 485*d* is deformed to partially conform to the outer surface of the insulative layer 464*d*. The insulation material 485*d* may be a dielectric material having an adhesive property and directly bonding the insulated conductor 420*d* to the insulative layer 464*d*. A dielectric material may be described as having an adhesive property if it can bond to the insulative layer without utilizing any additional adhesive layers. For example, a polymeric material that can bond to the insulative layer under heat and/or pressure may be used as a dielectric material with an adhesive property. Suitable dielectric materials having an adhesive property include polyolefins, for example.

Figure 8E:
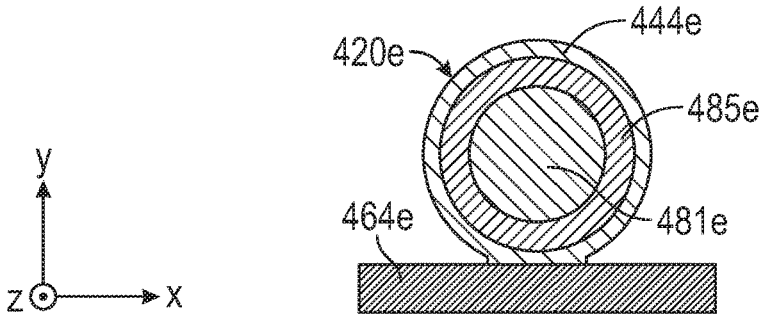
Figure 8F:
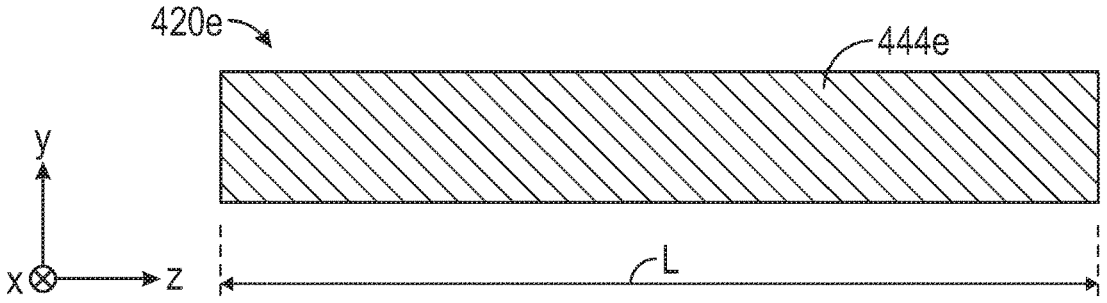
FIG. 8F is a schematic top view of an insulated conductor coated with a bonding layer.

FIG. 8E is a schematic cross-sectional view of an insulated conductor 420*e* bonded to an insulative layer 464*e* through a bonding layer 444*e*. The insulated conductor 420*e* is circumferentially coated with the bonding layer 444*e* along the length of the cable. Insulated conductor 420*e* includes a conductor 481*e* and an insulation material 485*e* surrounding and insulating the conductor 481*e*. An uninsulated conductor may similarly be coated with a bonding layer to bond the conductor to an insulative layer. FIG. 8F is a top view of the insulated conductor 420*e* of FIG. 8E. The bonding layer 444*e* extends along the length L of the insulated conductor 420*e*.

The insulation material on the insulated conductor may be referred to as a dielectric material and the insulation material may have a dielectric constant in any of the ranges (e.g., greater than about 2.5) described elsewhere herein.

Various embodiments of ribbon cables including insulative layers having alternating higher and lower dielectric constant regions are schematically illustrated in FIGS. 9-14.

Figure 9:
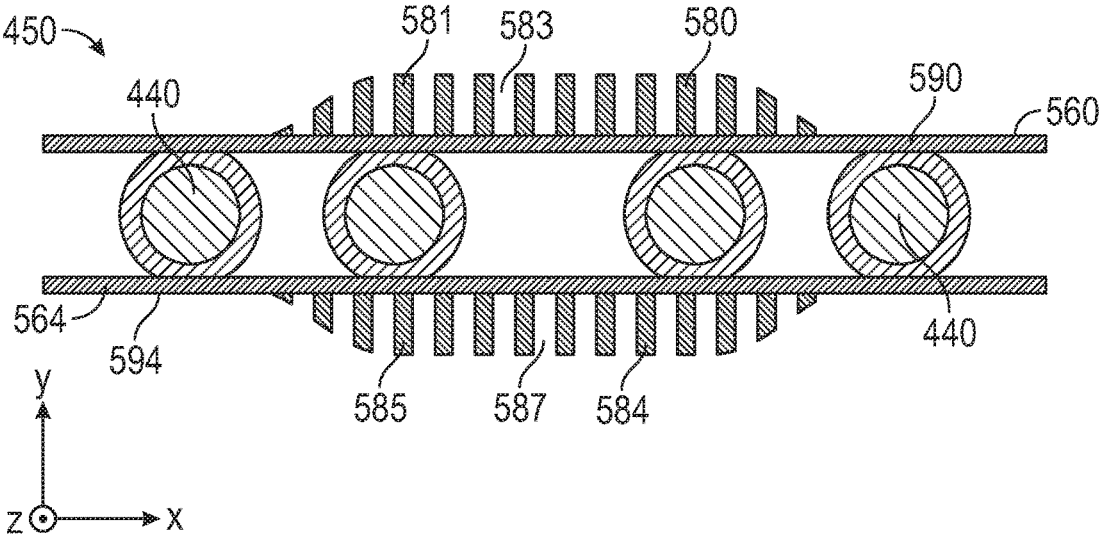
FIGS. 9-11C are schematic lateral cross-sectional views of ribbon cables.

FIG. 9 is a schematic cross-sectional view of a ribbon cable 450 including a plurality of insulated conductors 440 disposed between first and second insulative layers 560 and 564. First insulative layer 560 includes thicker portion 580 and thinner portions 590. The thicker portion 580 of the first insulative layer 560 includes a plurality of alternating higher dielectric constant regions 581 and lower dielectric constant regions 583. In some embodiments, the higher dielectric constant regions 581 define the lower dielectric constant regions 583 as spaces between the higher dielectric constant regions 581 that may be air filled, for example. Similarly, second insulative layer 564 includes thicker portion 584 and thinner portions 594. The thicker portion 584 of the second insulative layer 564 includes a plurality of alternating higher dielectric constant regions 585 and lower dielectric constant regions 587, which may be defined by the higher dielectric constant regions 585. The two center conductors (e.g., signal wired) in the plurality of insulated conductors 440 are disposed between the thicker portions 580 and 584 and the two outer conductors (e.g., ground wired) in the plurality of insulated conductors 440 are disposed between the thinner portions 590 and 594. The alternating higher dielectric constant regions 581 and/or 585 may extend continuously or discontinuously along the length of the cable as described further elsewhere herein. The insulated conductors 440 may be bonded to the first and second insulative layers 560 and 564 using any of the bonding techniques described elsewhere herein (see, e.g., FIGS. 8A-8F).

Figure 10:
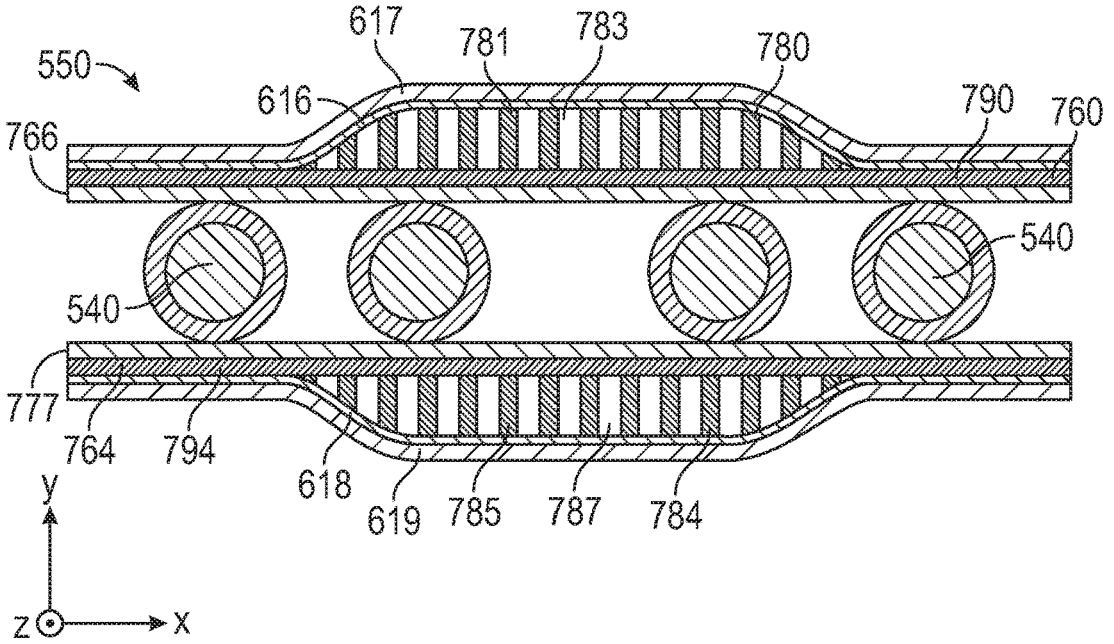

FIG. 10 is a schematic cross-sectional view of a ribbon cable 550 including a plurality of insulated conductors 540 disposed between first and second insulative layers 760 and 764. Ribbon cable 550 is in many respects similar to ribbon cable 450, and insulated conductors 540, first and second insulative layers 760 and 764, thicker portion 780, higher dielectric constant regions 781, lower dielectric constant regions 783, thicker portion 784, higher dielectric constant regions 785, lower dielectric constant regions 787, and thinner portions 790 and 794 may be as described for insulated conductors 440, first and second insulative layers 560 and 564, thicker portion 580, higher dielectric constant regions 581, lower dielectric constant regions 583, thicker portion 584, higher dielectric constant regions 585, lower dielectric constant regions 587, and thinner portions 590 and 594 of FIG. 9, respectively. In the embodiment illustrated in FIG. 10, the first and second insulative layers 760 and 764 are bonded to the plurality of insulated conductors 540 through bonding layers 766 and 777, respectively. A dielectric layer 616 is disposed on first insulative layer 760 and a dielectric layer 618 is disposed on second insulative layer 764. Dielectric layers 616 and/or 618 may be included to provide increased structural rigidity, for example. Conductive shielding layer 617 is disposed in dielectric layer 616 and conductive shielding layer 619 is disposed on dielectric layer 618. One or both of the dielectric layers 616 and 618 may optionally be omitted and the conductive shielding layers 617 and 619 may be disposed directly on the first and second insulative layers 760 and 764, respectively.

Figure 11A:
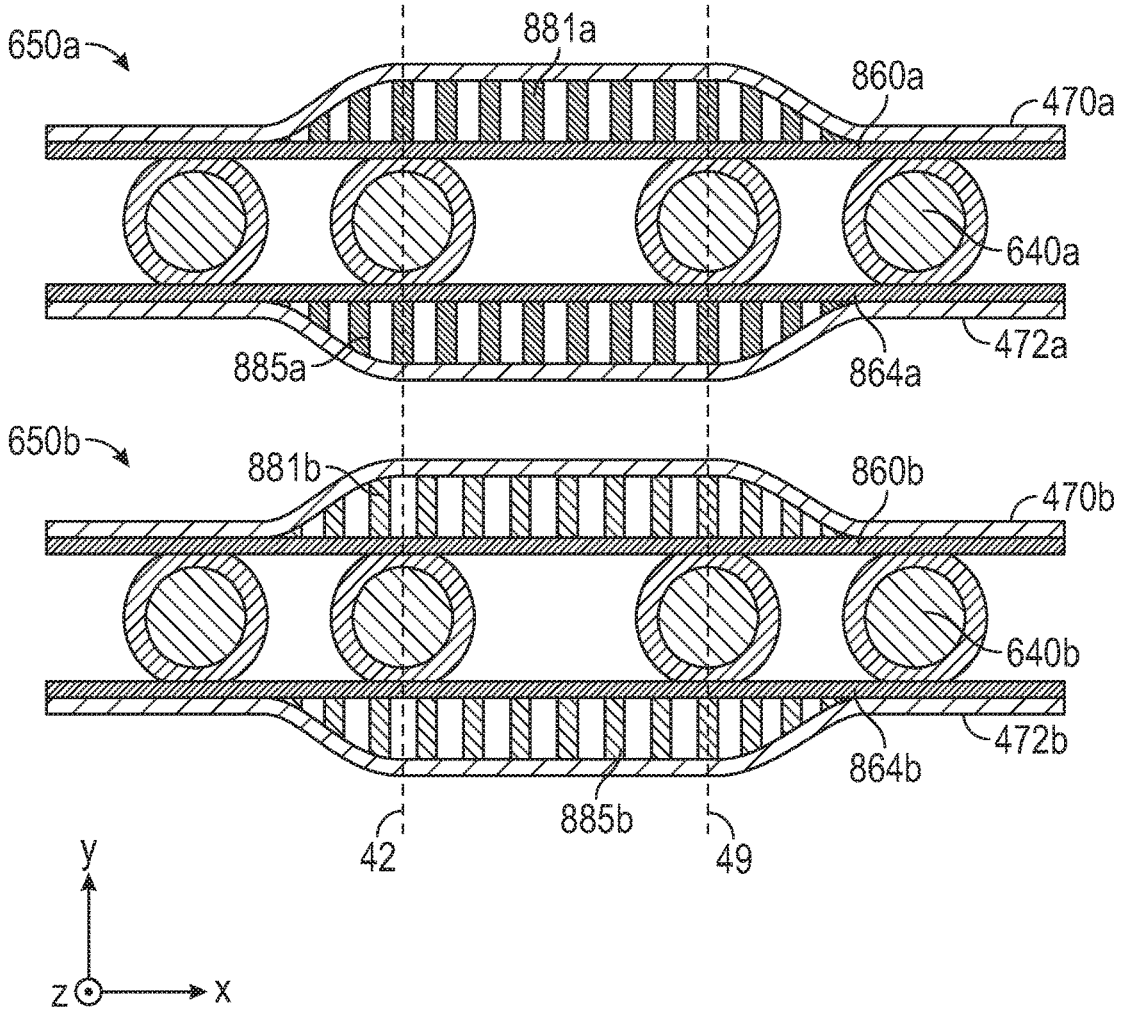

FIG. 11A is a schematic cross-sectional view of ribbon cables 650*a* and 650*b* including a plurality of insulated conductors 640*a* and 640*b*, respectively, disposed between first and second insulative layers 860*a* and 864*a*, and 860*b* and 864*b*, respectively. First and second electrically conductive shielding layers 470*a* and 472*a*, and 470*b* and 472*b*, are also included. Centerlines 42 and 49 through the center pair of conductors in the plurality of insulated conductors 640*a* and 640*b* are shown. The structures 881*a* and 885*a*, which in the illustrated embodiment are higher dielectric constant regions that alternate with lower dielectric constant regions (e.g., air gaps between the structures), are symmetrically balanced about the insulated conductors 640*a*, while the structures 881*b* and 885*b* are not symmetrically balanced since the centerline 49 intersects a structure 881*b* and 885*b* while the centerline 42 does not. The structures 881*a* and 885*a* may be described as providing alternating higher and lower dielectric constant regions having a same distribution across the width of each conductor disposed between corresponding thicker portions of the first and second insulative layers 860*a* and 864*a*. The structures 881*b* and 885*b* may be described as providing alternating higher and lower dielectric constant regions having different distributions across the widths of the two conductors disposed between the corresponding thicker portions of the first and second insulative layers 860*b* and 864*b*. Structures symmetrically placed around the insulated conductors may be preferred in some embodiments so that the center pair of conductors are surrounded by a same distribution of dielectric materials. In other embodiments, the dielectric structures are sufficiently finely spaced that the difference in the distribution of dielectric materials around the center pair of conductors is negligible even when the structures are not symmetrically placed. In some embodiments, the structures of the upper layer and of the lower layer are arranged in different patterns.

In some embodiments, the structures are regularly spaced and in other embodiments, the structures are irregularly spaced. In the embodiments illustrated in FIG. 11A, the alternating higher and lower dielectric constant regions are regularly spaced along the width of the thicker portions of the insulative layers. In the embodiments illustrated in FIG. 11B-11C, the alternating higher and lower dielectric constant regions are irregularly spaced along the width of the thicker portions of the insulative layers.

Figure 11B:
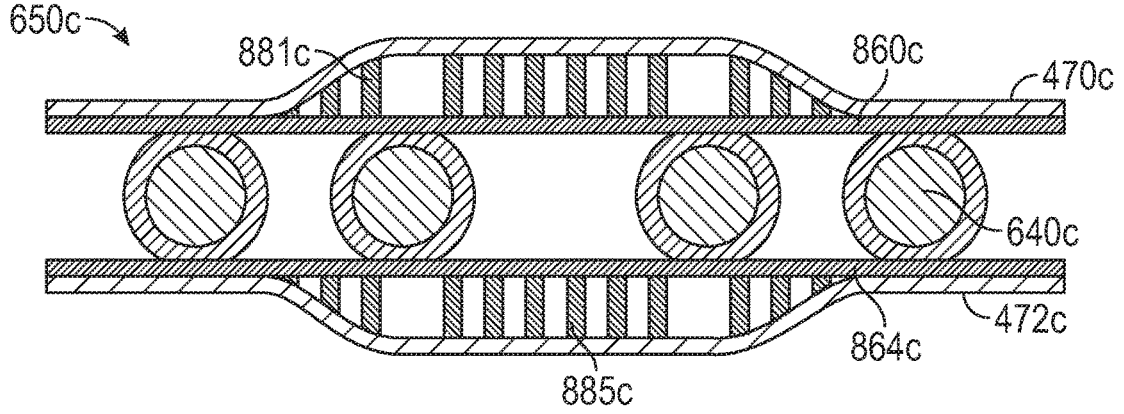

FIG. 11B is a schematic cross-sectional view of ribbon cable 650*c* including a plurality of insulated conductors 640*c*, disposed between first and second insulative layers 860*c* and 864*c*. First and second electrically conductive shielding layers 470*c* and 472*c* are also included. The first and second insulative layers 860*c* and 864*c* include structures 881*c* and 885*c* which in the illustrated embodiment may be described as higher dielectric constant regions which alternate with lower dielectric constant regions (e.g., air gap between the structures). In the embodiment illustrated in FIG. 11B, the structures are arranged less densely directly over each conductor in the center pair and more densely in the space between the center pairs of conductors. This has been found to result in a lower effective dielectric constant of the cable.

Figure 11C:
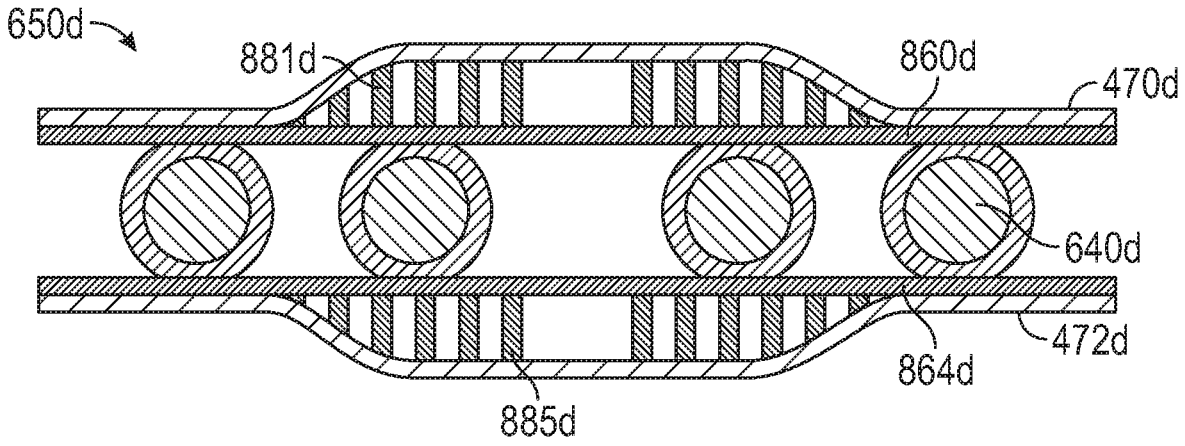

FIG. 11C is a schematic cross-sectional view of ribbon cable 650*d* including a plurality of insulated conductors 640*d*, disposed between first and second insulative layers 860*d* and 864*d*. First and second electrically conductive shielding layers 470*d* and 472*d* are also included. The first and second insulative layers 860*d* and 864*d* include structures 881*d* and 885*d* which in the illustrated embodiment may be described as higher dielectric constant regions which alternate with lower dielectric constant regions (e.g., air gap between the structures). In the embodiment illustrated in FIG. 11C, the structures are arranged more densely directly over each conductor in the center pair and less densely in the space between the center pairs of conductors. It has been found that this can be beneficial in providing greater mechanical support directly over the wires (e.g., to resist normal compressive forces) and can result in a lower effective dielectric constant of the cable due to the lower density of the structures between the center conductors.

Figure 12:
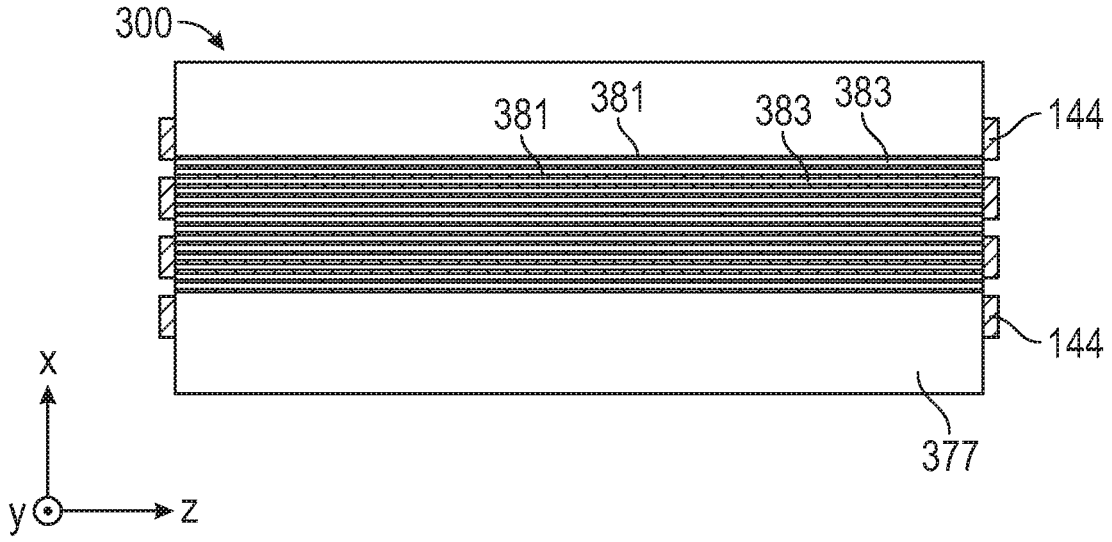

FIG. 12 is a schematic top view of a ribbon cable 300 including a plurality of conductors 144 disposed between an insulative layer 377 and an opposing insulative layer (not shown). Insulative layer 377 includes alternating higher and lower dielectric constant regions 381 and 383 which extend continuously substantially along the length of the cable. Cable 300 may correspond to cable 450, for example. In other embodiments, the alternating higher and lower dielectric constant regions 381 and 383 may be discontinuous.

Figure 13:
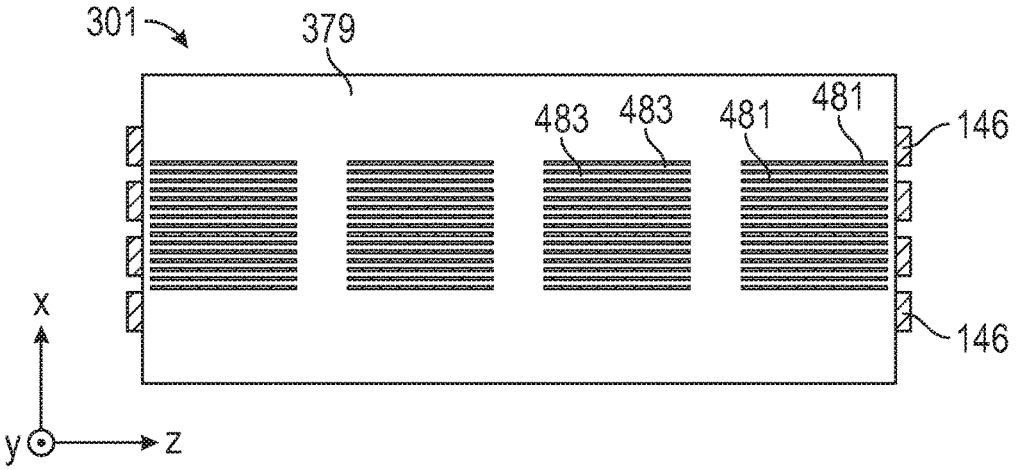

FIG. 13 is a schematic top view of a ribbon cable 301 including a plurality of conductors 146 disposed between an insulative layer 379 and an opposing insulative layer (not shown). Insulative layer 379 includes alternating higher and lower dielectric constant regions 481 and 483 which extend discontinuously along the length of the cable. Cable 301 may correspond to cable 450, for example.

In some embodiments, an insulative layer includes alternating higher and lower dielectric constant regions and includes material deposited into the lower dielectric constant regions. The material may be deposited along rows to form ribs. In some embodiments, the insulative layer includes a plurality of ribs disposed in the lower dielectric regions, extending across the higher dielectric constant regions, and arranged along the length of the cable.

Figure 14A:
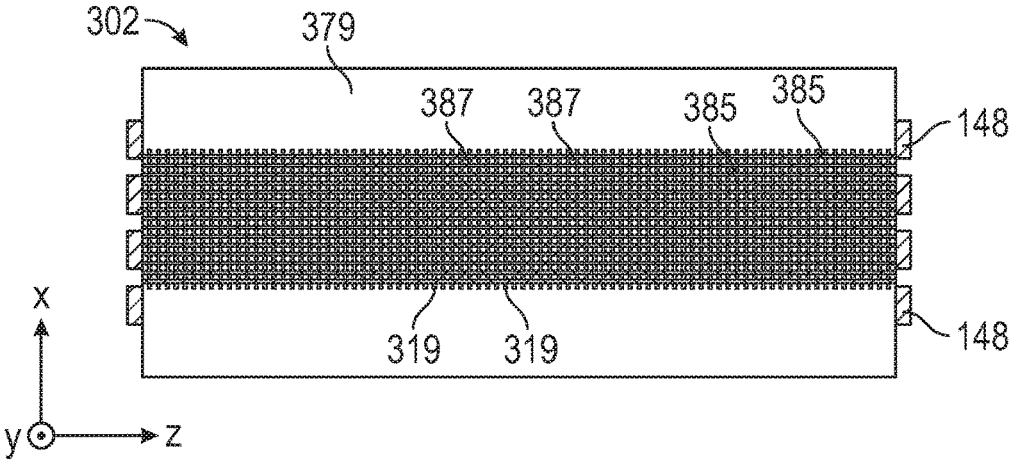
Figure 14B:
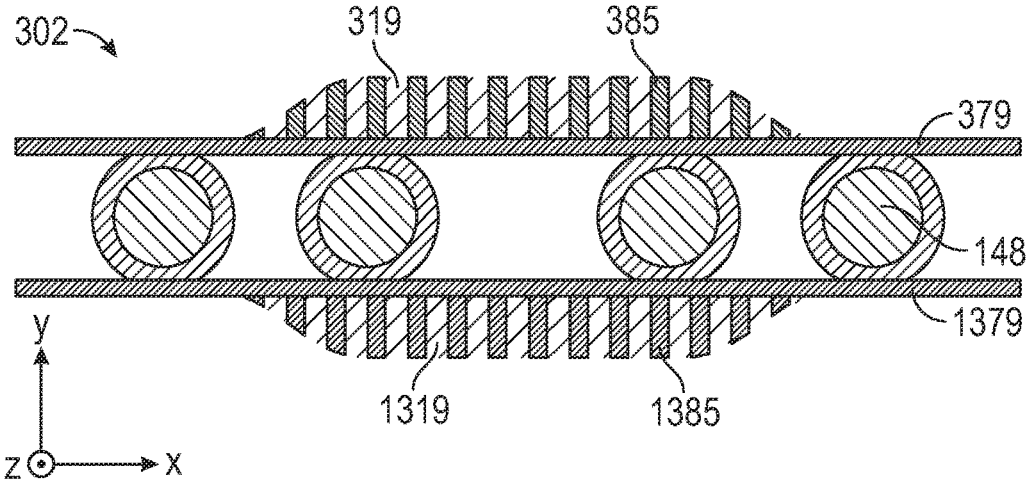
FIG. 14B is a schematic lateral cross-sectional view of the ribbon cable of FIG. 14A.

FIGS. 14A-14B are a schematic top and cross-sectional views, respectively, of a ribbon cable 302 including a plurality of insulated conductors 148 disposed between an insulative layer 379 and an opposing insulative layer 1379. Insulative layer 379 includes alternating higher and lower dielectric constant regions 385 and 387. In some embodiments, alternating higher and lower dielectric constant regions 385 and 387 extend continuously along the length of the cable. In other embodiments, the alternating higher and lower dielectric constant regions extend discontinuously along the length of the cable. Cable 302 may correspond to cable 450, for example. Ribbon cable 302 includes a plurality of ribs 319. In some embodiments, the ribs 319 are deposited in the lower dielectric constant regions in order to improve the mechanical properties of the cable. FIG. 14B is a cross-section through one of the ribs 319. A rib 1319 between higher dielectric constant regions 1385 in the opposing insulative layer 1379 is also shown. The ribs 319 provide different dielectric content in different lateral cross-sections. However, if the spacing between the ribs 319 is small compared to the wavelength of the desired driving signal at the fundamental frequency of the driving signal the contribution of the ribs 319 is averaged in determining the effective dielectric constant of the cable. The ribs may be periodically or irregularly arranged along the length of the cable. The ribs may be substantially perpendicular to the rows of higher dielectric constant regions.

In some embodiments, the higher dielectric constant regions extend linearly along the length of the cable. In some embodiments, the higher dielectric constant regions extend along a direction at an oblique angle to the length of the cable. Ribs perpendicular or at some other angle relative to this direction may also be included. Other patterns of the alternating higher and lower dielectric constant regions may be utilized. For example, a honeycomb pattern may be used where the higher dielectric constant regions form the boundary of the honeycomb pattern and the interior regions of the honeycomb are the lower dielectric constant regions.

Figure 15:
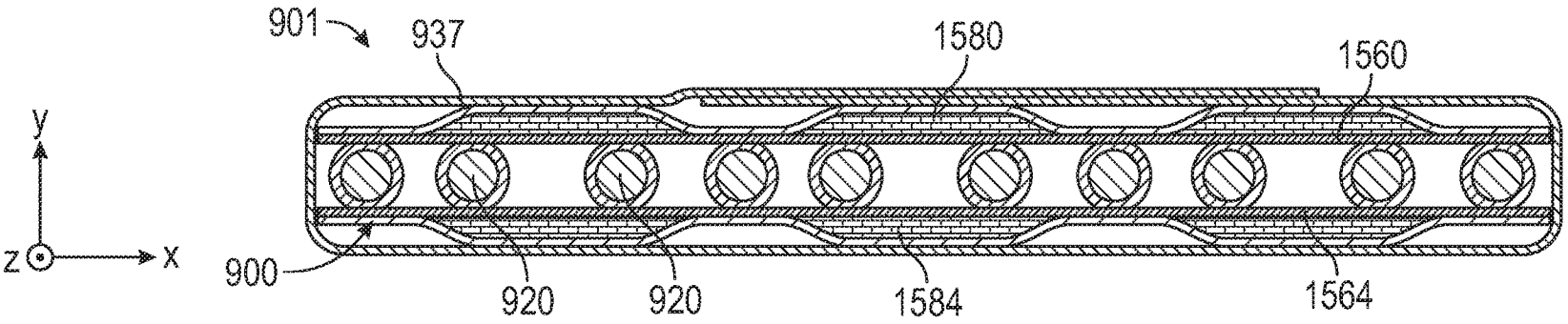
FIGS. 15-17 are schematic lateral cross-sectional views of ribbon cables.

In some embodiments, conductive shielding layers are disposed on opposite sides of and substantially coextensive with the respective first and second insulative layers along the length and width of the cable, each insulative layer disposed between the conductors and the shielding layer corresponding to the insulative layer. In some embodiments, an additional insulating layer is included around the shielding layer. FIG. 15 is a schematic cross-sectional view of a ribbon cable 901 including an insulating layer 937 wrapped around cable 900 which may correspond to or may be similar to cable 100, for example. Cable 900 includes a plurality of insulated conductors 920 and insulative layers

1560 and 1564 including alternating thicker and thinner portions. The thicker portions 1580 and 1580 may be substantially aligned and in one to one correspondence. In the illustrated embodiment, two conductors (e.g., signal wires) are disposed between the thicker portions 1580 and 1584 and a conductor (e.g., ground wire) is disposed between each thinner portions of the insulative layers 1560 and 1564.

In some embodiments, the insulative layer(s) have a low effective dielectric constant across the width of the layer without including alternating thicker lower dielectric constant and thinner higher dielectric constant portions.

Figure 16:
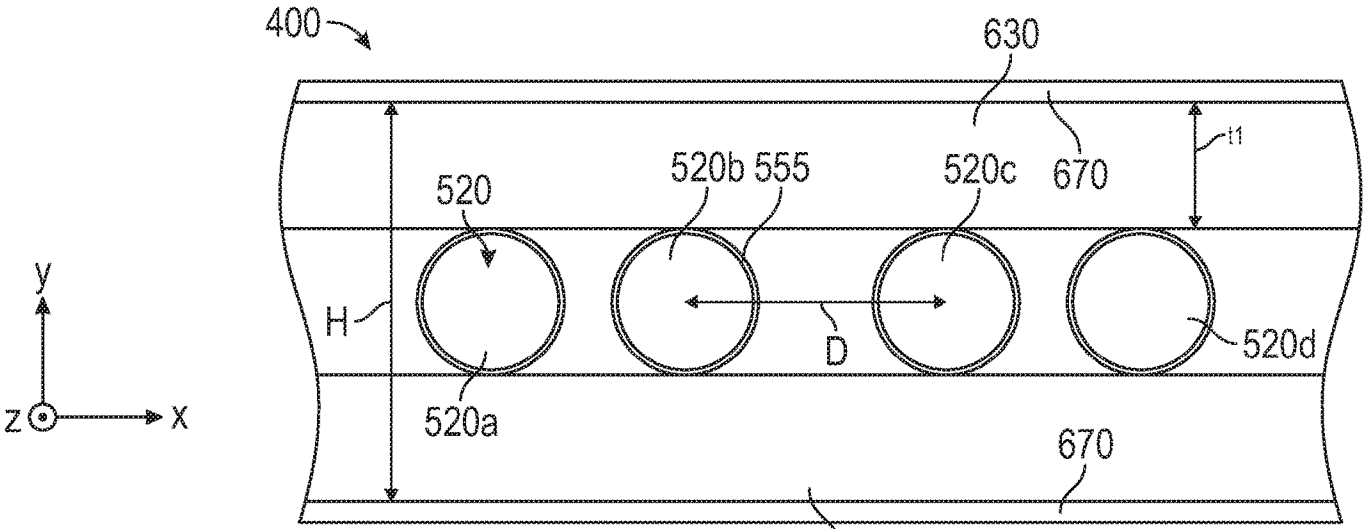

FIG. 16 is a schematic lateral cross-sectional view of a ribbon cable 400 including a plurality of substantially parallel insulated conductors 520 extending along a length of the cable and arranged along a width of the cable. The plurality of conductors 520 include conductors 520*a*-520*d*. In some embodiments, the conductors 520*b* and 520*c* are signal wires and the conductors 520*a* and 520*d* are ground wires. A center to center separation between two adjacent insulated conductors 520*b* and 520*c* in the plurality of insulated conductors 520 is D and an average of the diameters of the two insulated conductors is d, as described further elsewhere herein (see, e.g., FIG. 7B were d=½(R1+R2)). In some embodiments, D/d is greater than or equal to 1.05, or greater than or equal to 1.1, or greater than or equal to 1.3, or greater than or equal to 1.4, or greater than or equal to 1.5. In some embodiments, D/d is no more than 3, or no more than 2.5, or no more than 2. In some embodiments, each conductor in the pair of adjacent insulated conductors is insulated with a dielectric material 555. It has been found that if the dielectric material 555 is sufficiently thin, the dielectric material 555 can have a high dielectric constant without substantially affecting the effective dielectric constant of the cable. In some embodiments, the dielectric material 555 has a thickness less than about 100 micrometers, or less than about 75 micrometers, or less than about 50 micrometers, or less than about 30 micrometers, or less than about 20 micrometers, or less than about 15 micrometers. In some embodiments, the dielectric material 555 has a thickness greater than about 1 micrometers, or greater than about 5 micrometers. In some embodiments, the dielectric material 555 has a dielectric constant greater than about 2, or greater than about 2.5, or greater than about 2.8, or greater than about 3, or greater than about 3.2, or greater than about 3.4, or greater than about 3.6, or greater than about 3.8, or greater than about 4. In some embodiments, an effective dielectric constant of the cable for at least one pair of adjacent insulated conductors driven with differential signals of equal amplitude and opposite polarities is less than about 2.5, or less than about 2.2, or less than about 2, or less than about 1.8, or less than about 1.6, or less than about 1.5, or less than about 1.4, or less than about 1.3, or less than about 1.2.

In some embodiments, an insulative layer 630 surrounds the plurality of the insulated conductors 520. In some embodiments, the insulative layer 630 has a thickness t1 greater than about 200 micrometers, or greater than about 250 micrometers, or greater than about 300 micrometers. In some embodiments, the thickness t1 is less than about 5 mm, or less than about 3 mm, or less than about 1 mm, or less than about 0.5 mm. In some embodiments, the insulative layer 630 has an effective dielectric constant of less than about 2, or less than about 1.8, or less than about 1.6, or less than about 1.4, or less than about 1.3, or less than about 1.2. It has been found that utilizing a low (e.g., less than about 2) dielectric constant for the insulative layer 630 allows a greater flexibility in choosing the spacing between adjacent conductors (e.g., D) and the spacing H between opposing sides of the shielding layer 670 for a given target cable impedance (e.g., 70 to 110 ohms). For example, the spacing between adjacent conductors can be increased and the spacing H decreased to provide a thinner and more flexible cable, or the spacing between adjacent conductors can be decreased and the spacing H increased to provide a higher density of conductors. H may be equal to or about equal to D or may be substantially different from D. In some embodiments, D<H, and in some embodiments, D>H.

In some embodiments, the dielectric material 555 has an adhesive property and directly bonds the insulated conductors 520 to the insulative layer 630, as described further elsewhere herein. In some embodiments, a bonding layer is disposed between the insulative layer 630 and the insulated conductors 520.

In some embodiments, the insulative layer 630 is a continuous single insulative layer wrapped around the plurality of conductors 520. In some embodiments, the insulative layer 630 includes layer portions (e.g., top and bottom layer portions) on opposite sides of the plurality of conductors 520. Shielding layer 670 may be a single layer wrapped around the cable or may include opposing first and second layer portions which may make electrical contact at edges of the cable, for example.

Figure 17:
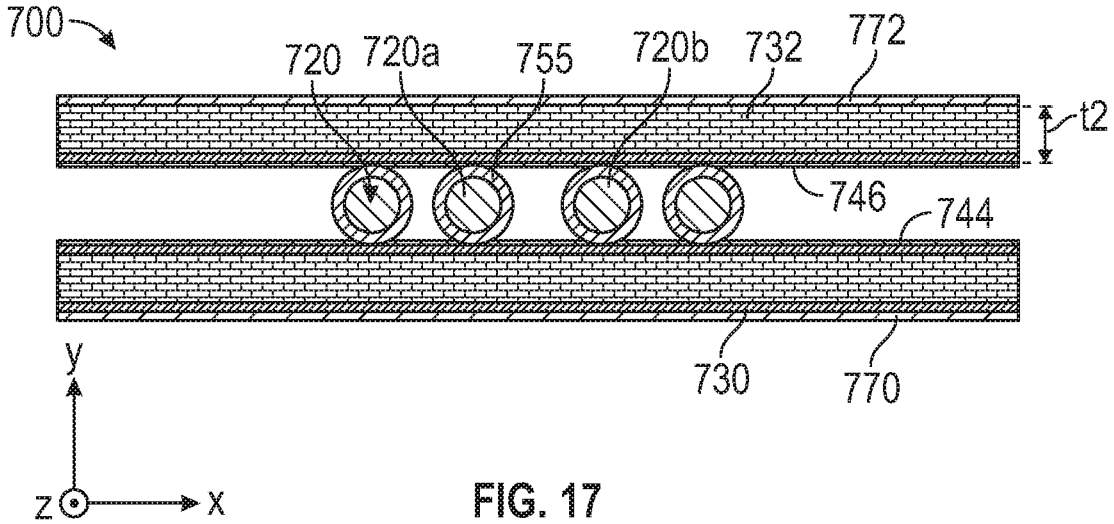

FIG. 17 is a schematic lateral cross-sectional view of a ribbon cable 700 including a plurality of spaced apart substantially parallel insulated conductors 720 extending along a length of the cable and arranged along a width of the cable. Each insulated conductor is insulated with a dielectric material having a thickness greater than or equal to zero. It has been found that using a thin (e.g., less than about 100 micrometers, or less than about 75 micrometers, or less than about 50 micrometers, or less than about 30 micrometers, or less than about 20 micrometers, or less than about 15 micrometers) dielectric material or omitting the dielectric material can contribute to a low propagation delay of the cable. In some embodiments, for each pair of adjacent insulated conductors (e.g., 720*a* and 720*b*) in the plurality of insulated conductors 720, a center to center separation between the two conductors is D, an average of diameters of the two insulated conductors is d, and D/d is greater than or equal to 1.05, or greater than or equal to 1.1, or greater than or equal to 1.2, or greater than or equal to 1.4. In some embodiments, for at least one pair of adjacent insulated conductors (e.g., 720*a* and 720*b*) in the plurality of insulated conductors 720, D/d is greater than or equal to 1.4, or greater than or equal to 1.5. In some embodiments, for each pair of adjacent insulated conductors in the plurality of insulated conductors 720, D/d is no more than 3, or no more than 2.5, or no more than 2.

The ribbon cable 700 includes first and second insulative layer portions 730 and 732 disposed on opposite sides of and substantially coextensive with the plurality of insulated conductors 720 across the length and width of the cable. In some embodiments, a separation between the first and second insulative layer portions 730 and 732 varies by no more than about 20% along the length and width of the cable 700. In some embodiments, each of the first and second insulative layer portions 730 and 732 have effective dielectric constant of less than about 2, or less than about 1.8, or less than about 1.6, or less than about 1.4, or less than about 1.2. In some embodiments, the first and second insulative layer portions 730 and 732 are bottom and top portions of a single insulative layer wrapped around the plurality of insulated conductors 720. The first and second insulative layer portions 730 and 732 have a thickness of t2 which may be in any of the ranges described elsewhere herein for t1.

The ribbon cable 700 further include conductive shielding layer portions 770 and 772 on opposing sides of the cable, and bonding material 774 between the first insulative layer portion 730 and the plurality of insulated conductors 720, and bonding material 746 between the second insulative layer portion 732 and the plurality of insulated conductors 720.

In some embodiments, for at least one pair of adjacent insulated conductors (e.g., 720*a* and 720*b*), an effective dielectric constant of the cable for the pair of conductors driven with differential signals of equal amplitude and opposite polarities is less than about 2.5, or less than about 2.2, or less than about 2, or less than about 1.8, or less than about 1.6, or less than about 1.5, or less than about 1.4, or less than about 1.3, or less than about 1.2. In some embodiments, each of the conductors 720 has a propagation delay of less than about 4.75 nsec/meter at data transfer speeds from about 1 Gbps to about 20 Gbps. In some embodiments, each of the conductors 720 has a propagation delay of less than about 4.75 nsec/meter, or less than about 4.5 nsec/meter, or less than about 4.25 nsec/meter, or less than about 4 nsec/meter, or less than about 3.75 nsec/meter at data transfer speeds from about 1 Gbps to about 20 Gbps, or from about 1 Gbps to about 50 Gbps, or from about 1 Gbps to about 75 Gbps, or from about 1 Gbps to about 100 Gbps.

In some embodiments, one or both of the first and second insulative layers of any of the cables of the present description is flexible. In some embodiments, the ribbon cable is flexible. A layer or a cable may be described as flexible if it can be bent to a 180 degree angle at a radius of curvature of no more than 5 cm without damage to the layer or cable. In some embodiments, the overall thickness can be reduced and the spacing between the conductors increased while maintaining a target impedance and this can result in an increased flexibility of the cable. In some embodiments, the thicker, lower effective dielectric constant regions of the insulative layers allow the outer shielding films to deform (e.g., forming accordion-like lateral folds) and spread the strain from bending over a larger area compared to cables utilizing a solid dielectric construction and this can improve the flexibility of the cable. In addition, this may help to maintain the position and spacing of the insulated conductors relative to the shielding films along the length of the cable, which may result in superior signal integrity of the cable. The flexibility of a cable can be characterized in term of a rebound angle after bending the cable to a 180 degree bend at a fixed radius of curvature. For example, in some embodiments, a ribbon cable bent to 180 degrees at a radius of curvature of 1 cm, or of 5 mm, or of 1 mm, will rebound to no less than a 150 degree bend (i.e., a rebound angle of less no more than 30 degrees) upon removing the bending force. Structured insulative layers having alternating higher and lower dielectric constant regions, for example, can be made using conventional microreplication methods such as casting and curing the structures a polymerizable resin composition in contact with a tool surface onto a substrate, cutting the structures into a substrate, or extruding a film having suitable structures on a major surface of the film. Suitable casting and curing processes are described in U.S. Pat. No. 5,175,030 (Lu et al.), U.S. Pat. No. 5,183,597 (Lu), and U.S. Pat. App. Pub. No. 2012/0064296 (Walker, J R. et al.). The tool used in the cast and cure process may be fabricated using any available fabrication method, such as by using engraving or diamond turning. Engraving or diamond turning can also be used to cut structures directly into a substrate. Exemplary diamond turning systems and methods can include and utilize a fast tool servo (FTS) as described in, for example, U.S. Pat. No. 7,350,442 (Ehnes et al.), U.S. Pat. No. 7,328,638 (Gardiner et al.), and U.S. Pat. No. 6,322,236 (Campbell et al.).

The thicker portions of an insulative layer may be foamed to provide a lower dielectric constant. The thicker portions can be formed on a substrate by coating a foamable material onto the substrates in desired locations (e.g., strips) to provide the thicker portions. The foamable material can then be foamed (e.g., via application of heat) to form the thicker portions having a lower effective dielectric constant than the thinner portions.

The foamable material may be made from a same or different polymer than the substrate and a foaming agent may be added to the polymer to provide the desired foaming. Suitable foaming agents include an expandable sphere foaming agent that includes thermoplastic spheres, for example, that include a shell encapsulating a hydrocarbon or other appropriate gas that expands when exposed to heat or other activation source. Expansion of the thermoplastic shell results in an increased volume and reduced density of the material. The foaming agent may also be a chemical foaming agent. Activation of such a foaming agent causes the expandable material to expand creating voids or gaps in the material of the thicker portions of the insulative layers. A combination of expandable sphere foaming agents can chemical foaming agents may also be used.

Suitable expandable sphere foaming agents include EXPANCEL 930 DU 120, EXPANCEL 920 DU 120, both available from Eka Chemicals AB of Sundsvall, Sweden. Suitable chemical foaming agents include oxybis benzene sulfonyl hydrazide (OBSH) available from Biddle Sawyer Corp. of New York, N.Y. Suitable foaming agents are described in U.S. Pat. No. 8,679,607 (Hamer et al.). In some embodiments, an insulative layer is formed by extrusion. For example, the thicker portions may include alternating high and low dielectric regions extending along the length of the insulative layer where the high dielectric constant regions are ribs formed via extrusion. Extrusion can be used to form the structures 117*a*, 117*b*, 119*a*, and 119*b* of FIGS. 3A-3B, for example, at the same time the alternating high and low dielectric regions are formed. As another example, the insulative layer may be extruded as a corrugated dielectric. In other embodiments, a corrugated dielectric may be made separately and then attached to a substrate to form the thicker portions of the insulative layer or to form an insulative layer with a low effective dielectric constant across a width of the layer.

Each insulative layer may be formed of any suitable length and width. The insulative layer may then be provided as such or cut to a desired length and/or width for incorporation into the cable.

Methods of making shielded electrical cables are known in the art. For example, suitable methods are described in U.S. Pat. No. 8,859,901 (Gundel).

Insulated conductors may be formed using any suitable method, such as, e.g., extrusion, or are otherwise provided. The insulated conductors may be formed in any suitable length. The insulated conductors may then be provided as such or cut to a desired length.

A shielding film for use as a shielding layer in the ribbon cable may be formed using any suitable method, such as, e.g., continuous wide web processing. Each shielding film may be formed of any suitable length. The shielding film may then be provided as such or cut to a desired length and/or width. The shielding film may be pre-formed to have transverse partial folds to increase flexibility in the longitudinal direction. One or both of the shielding films may include a conformable adhesive layer, which may be formed on the shielding film using any suitable method, such as, e.g., laminating, coating or sputtering.

Figure 18A:
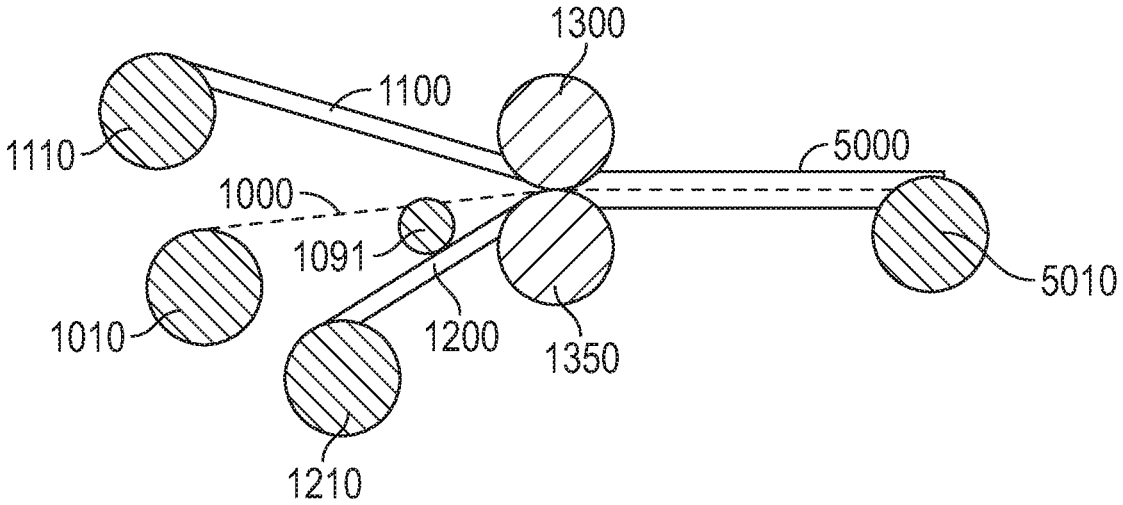
FIGS. 18A-18B schematically illustrate a method of making a ribbon cable.
Figure 18B:
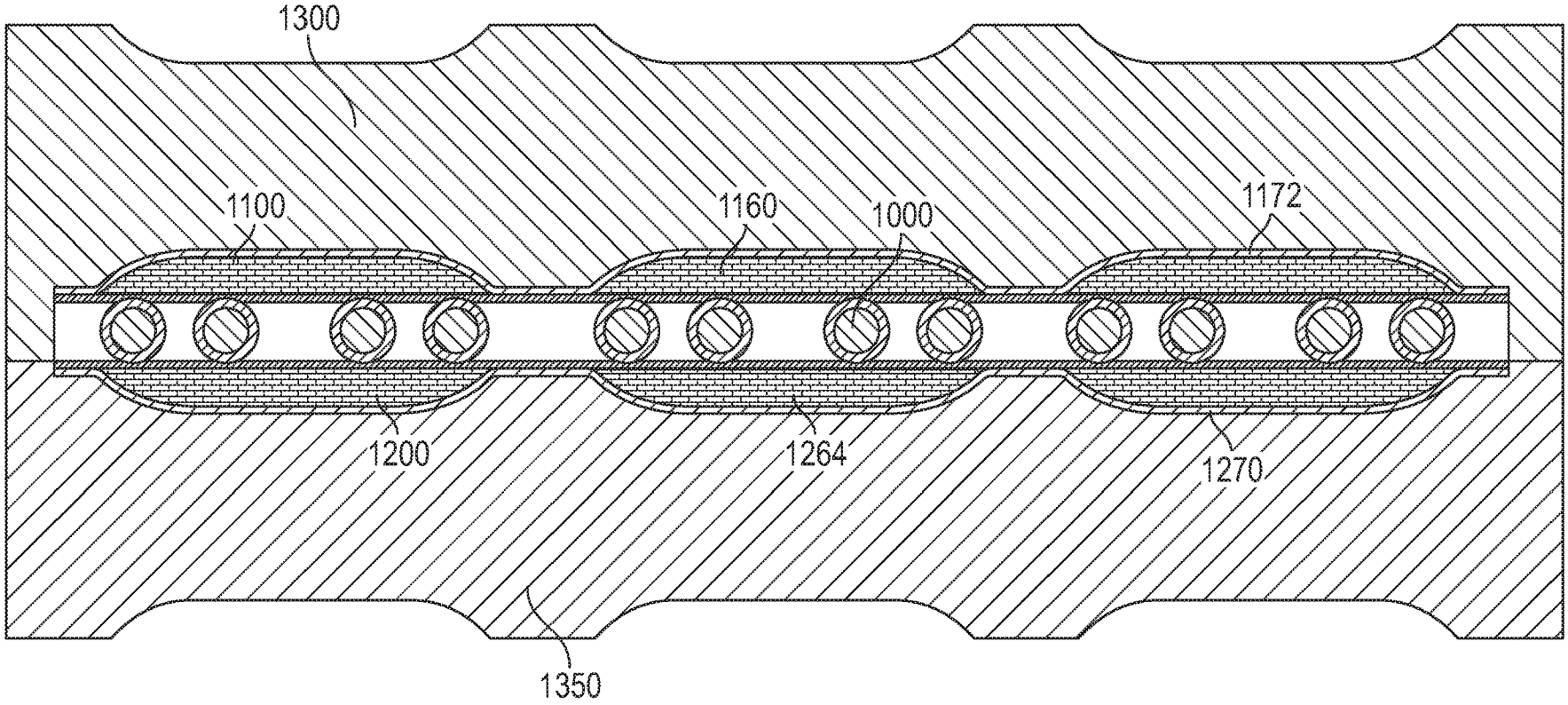

FIG. 18A schematically illustrates a method of making a ribbon cable 5000. Wires 1000 are placed between films 1100 and 1200 and passed through forming rolls 1300 and 1350 to form the ribbon cable 5000. FIG. 18B is a cross-sectional view of the ribbon cable 5000 between the forming rolls 1300 and 1350. The films 1100 and 1200 are provided on rolls 1010 and 1210 and the wires 1000 are provided on roll 1010. A wire guide 1091 is provided to ensure the wires 1000 are placed in desired locations. The ribbon cable 5000 is wound onto roll 5010. Film 1100 includes a first insulative layer 1160 and film 1200 includes a second insulative layer 1264. Film 1100 may also include a shielding layer 1172, and film 1200 may also include a shielding layer 1270. Alternatively, shielding layers 1172 and 1270 may be fed into a fed into a bite of the forming rolls 1300 and 1350 as layers separate from the films 1100 and 1200 and then bonded to the films 1100 and 1200 during the process of making the ribbon cable 5000.

Forming rolls 1300 and 1350 have a shape corresponding to a desired cross-sectional shape of the ribbon cable 5000. The wires 1000, which are insulated conductors in the illustrated embodiment, and insulative layers 1160 and 1264, and shielding layers 1172 and 1270 are arranged according to the configuration of the desired ribbon cable 5000, such as any of the cables shown and/or described herein, and positioned in proximity to forming rolls 1300 and 1350, after which they are concurrently fed into a bite of the forming rolls 1300 and 1350 and disposed between the forming rolls 1300 and 1350. The films 1100 and 1200 are formed around and bonded to the wires 1000. Heat may be applied to facilitate bonding. In the illustrated embodiment, the films 1100 and 1200 are formed around and bonded to the wires 1000 in a single step. In other embodiments, these steps may occur in separate operations. Other layers can be included in the arrangement that is fed into the bite of forming rolls 1300 and 1350. For example, one or more electromagnetic interference (EMI) absorbing layers, one or more protective layers, and/or one or more jacket layers can be included in the arrangement and fed into the bite.

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

Terms such as "substantially" will be understood in the context in which they are used and described in the present description by one of ordinary skill in the art. If the use of "substantially equal" is not otherwise clear to one of ordinary skill in the art in the context in which it is used and described in the present description, "substantially equal" will mean about equal where about is as described above. If the use of "substantially parallel" is not otherwise clear to one of ordinary skill in the art in the context in which it is used and described in the present description, "substantially parallel" will mean within 30 degrees of parallel. Directions or surfaces described as substantially parallel to one another may, in some embodiments, be within 20 degrees, or within 10 degrees of parallel, or may be parallel or nominally parallel. If the use of "substantially aligned" is not otherwise clear to one of ordinary skill in the art in the context in which it is used and described in the present description, "substantially aligned" will mean aligned to within 20% of a width of the objects being aligned. Objects described as substantially aligned may, in some embodiments, be aligned to within 10% or to within 5% of a width of the objects being aligned.

The following is a list of exemplary embodiments of the present description.

Embodiment 1 is a ribbon cable, comprising:

a plurality of spaced apart substantially parallel conductors extending along a length of the cable and arranged along a width of the cable; and first and second insulative layers disposed on opposite sides of and substantially coextensive with the plurality of conductors along the length and width of the cable, each insulative layer adhered to the conductors and comprising alternating substantially parallel thicker and thinner portions extending along the length of the cable, the thicker portions of the first and second insulative layers substantially aligned in one to one correspondence, each corresponding thicker portions of the first and second insulative layers having at least one conductor in the plurality of conductors disposed therebetween.

Embodiment 2 is the ribbon cable of Embodiment 1, wherein effective dielectric constants of the thicker portions are lower than effective dielectric constants of the thinner portions.

Embodiment 3 is the ribbon cable of Embodiment 1, wherein effective dielectric constants of the thicker portions are substantially equal to effective dielectric constants of the thinner portions.

Embodiment 4 is the ribbon cable of any one of Embodiments 1 to 3, wherein at least one of the first and second insulative layers comprises a polymer.

Embodiment 5 is the ribbon cable of any one of Embodiments 1 to 3, wherein each of the first and second insulative layers comprises a polymer.

Embodiment 6 is the ribbon cable of any one of Embodiments 1 to 5, wherein at least one of the first and second insulative layers is flexible.

Embodiment 7 is the ribbon cable of any one of Embodiments 1 to 5, wherein each of the first and second insulative layers is flexible.

Embodiment 8 is the ribbon cable of any one of Embodiments 1 to 7 being flexible.

Embodiment 9 is the ribbon cable of any one of Embodiments 1 to 8, wherein each thicker portion of the first and second insulative layers comprises a plurality of alternating higher and lower dielectric constant regions.

Embodiment 10 is the ribbon cable of Embodiment 9, wherein the alternating higher and lower dielectric constant regions extend continuously along the length of the cable.

Embodiment 11 is the ribbon cable of Embodiment 9, wherein the alternating higher and lower dielectric constant regions extend discontinuously along the length of the cable.

Embodiment 12 is the ribbon cable of any one of Embodiments 9 to 11, further comprising a plurality of ribs disposed in the lower dielectric regions, extending across the higher dielectric constant regions, and arranged along the length of the cable.

Embodiment 13 is the ribbon cable of any one of Embodiments 9 to 12, wherein effective dielectric constants of the thinner portions are substantially equal to the dielectric constant of the higher dielectric constant regions.

Embodiment 14 is the ribbon cable of any one of Embodiments 1 to 13, wherein in at least one transverse cross-section of the cable, a difference between maximum and minimum separations between the first and second insulative layers across a width of a region between two end conductors in the plurality of conductors is less than about 20%, or less than about 10%, or less than about 5%.

Embodiment 15 is the ribbon cable of any one of Embodiments 1 to 14, wherein in at least one transverse cross-section of the cable, at least one of the first and second insulative layers comprises a plurality of structures, each conductor in the plurality of conductors disposed on and aligned with a structure in the plurality of structures.

Embodiment 16 is the ribbon cable of any one of Embodiments 1 to 14, wherein in at least one transverse cross-section of the cable, the first insulative layer comprises a plurality of first structures, the first insulative layer comprises a plurality of second structures aligned with the plurality of first structures, each conductor in the plurality of conductors disposed on and aligned with a first structure in the plurality of first structures and a second structure in the plurality of second structures.

Embodiment 17 is the ribbon cable of any one of Embodiments 1 to 14, wherein in at least one transverse cross-section of the cable, each conductor in the plurality of conductors is disposed on an unstructured major surface of the first insulative layer and on an unstructured major surface of the second insulative layer.

Embodiment 18 is the ribbon cable of any one of Embodiments 1 to 17, wherein for at least one cable location between two adjacent conductors in the plurality of conductors, a separation between the first and second insulative layers varies by no more than about 20%, or less than about 10%, or less than about 5% along the length of the cable.

Embodiment 19 is the ribbon cable of any one of Embodiments 1 to 18 further comprising first and second conductive shielding layers disposed on opposite sides of and substantially coextensive with the respective first and second insulative layers along the length and width of the cable, each insulative layer disposed between the conductors and the shielding layer corresponding to the insulative layer.

Embodiment 20 is the ribbon cable of Embodiment 19, wherein each shielding layer substantially conforms to the alternating thinner and thicker portions of the corresponding insulative layer.

Embodiment 21 is the ribbon cable of any one of Embodiments 1 to 20, wherein at least one corresponding thinner portions of the first and second insulative layers has at least one conductor in the plurality of conductors disposed therebetween.

Embodiment 22 is the ribbon cable of any one of Embodiments 1 to 21 having a skew of less than about 20 psec/meter, or less than about 15 psec/meter, or less than about 10 psec/meter, or less than about 5 psec/meter at data transfer speeds from about 1 Gbps to about 20 Gbps.

Embodiment 23 is the ribbon cable of any one of Embodiments 1 to 21 having a skew of less than about 20 psec/meter, or less than about 15 psec/meter, or less than about 10 psec/meter, or less than about 5 psec/meter, at data transfer speeds from about 1 Gbps to about 20 Gbps, or about 1 Gbps to about 50 Gbps, or about 1 Gbps to about 75 Gbps, or about 1 Gbps to about 100 Gbps, or as determined using time domain reflectometry with a rise time of 35 picoseconds.

Embodiment 24 is the ribbon cable of any one of Embodiments 1 to 23, wherein at least one conductor in the plurality of conductors has a propagation delay of less than about 4.75 nsec/meter, or less than about 4.5 nsec/meter, or less than about 4.25 nsec/meter, or less than about 4 nsec/meter, or less than about 3.75 nsec/meter at data transfer speeds from about 1 Gbps to about 20 Gbps.

Embodiment 25 is the ribbon cable of any one of Embodiments 1 to 23, wherein at least one conductor in the plurality of conductors has a propagation delay of less than about 4.75 nsec/meter, or less than about 4.5 nsec/meter, or less than about 4.25 nsec/meter, or less than about 4 nsec/meter, or less than about 3.75 nsec/meter at data transfer speeds from about 1 Gbps to about 20 Gbps, or about 1 Gbps to about 50 Gbps, or about 1 Gbps to about 75 Gbps, or about 1 Gbps to about 100 Gbps.

Embodiment 26 is the ribbon cable of any one of Embodiments 1 to 25, wherein at least one conductor in the plurality of conductors has a propagation delay of less than about 4.75 nsec/meter, or less than about 4.5 nsec/meter, or less than about 4.25 nsec/meter, or less than about 4 nsec/meter, or less than about 3.75 nsec/meter as determined using time domain reflectometry with a rise time of 35 picoseconds.

Embodiment 27 is the ribbon cable of any one of Embodiments 1 to 26, wherein an effective dielectric constant of the cable for at least one pair of adjacent conductors driven with differential signals of equal amplitude and opposite polarities is less than about 2.2, or less than about 2, or less than about 1.8, or less than about 1.6, or less than about 1.5, or less than about 1.4, or less than about 1.3, or less than about 1.2.

Embodiment 28 is the ribbon cable of any one of Embodiments 1 to 27, wherein at least one conductor in the plurality of conductors is uninsulated along the length of the cable, the at least one uninsulated conductor adhered to the first and second insulative layers via one or more adhesive layers.

Embodiment 29 is the ribbon cable of Embodiment 28, wherein the one or more adhesive layers covers only portions of an outermost surface of the at least one uninsulated conductor.

Embodiment 30 is the ribbon cable of Embodiment 28, wherein the one or more adhesive layers covers at least portions of a top surface of the at least one uninsulated conductor and at least portions of a bottom surface of the at least one uninsulated conductor.

Embodiment 31 is the ribbon cable of any one of Embodiments 1 to 30, wherein at least one conductor in the plurality of conductors is insulated with a dielectric material along the length of the cable.

Embodiment 32 is the ribbon cable of Embodiment 31, wherein the at least one insulated conductor has a diameter R and the conductor of the at least one insulated conductor has a diameter r, R/r less than about 4, or less than about 3.5, or less than about 3, or less than about 2, or less than about 1.5.

Embodiment 33 is the ribbon cable of Embodiment 31 or 32, wherein the dielectric material of the at least one insulated conductor has a dielectric constant greater than about 3, or greater than about 3.2, or greater than about 3.4, or greater than about 3.6, or greater than about 3.8, or greater than about 4.

Embodiment 34 is the ribbon cable of any one of Embodiments 31 to 33, wherein the dielectric material of the at least one insulated conductor comprises one or more of a polyolefin, a solid polyolefin, a foamed polyolefin, a polyimide, a polyamide, a PTFE, a polyester, a polyurethane, polyesterimide, polyamide-imide, and a fluoropolymer.

Embodiment 35 is the ribbon cable of any one of Embodiments 31 to 34, wherein the dielectric material of the at least one insulated conductor has an adhesive property, the dielectric material directly adhering the at least one insulated conductor to the first and second insulative layers.

Embodiment 36 is the ribbon cable of any one of Embodiments 1 to 34, wherein at least one conductor in the plurality of conductors is circumferentially coated with a bonding layer along the length of the cable, the bonding layer directly adhering the at least one conductor to the first and second insulative layers.

Embodiment 37 is the ribbon cable of any one of Embodiments 1 to 36, wherein each thicker portion of the first and second insulative layers has an effective dielectric constant less than about 2, or less than about 1.8, or less than about 1.6, or less than about 1.4, or less than about 1.2.

Embodiment 38 is a conductor set, comprising:

a plurality of spaced apart substantially parallel conductors extending along a length of the conductor set and arranged along a width of the conductor set;

first and second non-conductive structured layers disposed on opposite sides of and substantially coextensive with the plurality of conductors along the length and width of the conductor set, each structured layer adhered to the conductors and comprising a plurality of higher dielectric constant regions defining a plurality of lower dielectric constant regions therebetween; and a conductive shielding layer wrapped around the first and second non-conductive structured layers.

Embodiment 39 is the conductor set of Embodiment 38, wherein each structured layer has an effective dielectric constant less than about 2, or less than about 1.8, or less than about 1.6, or less than about 1.4, or less than about 1.2.

Embodiment 40 is a shielded ribbon cable, comprising:

a plurality of spaced apart substantially parallel conductor sets of Embodiment 38 or 39 arranged along a width of the cable; and first and second insulative layers disposed on opposite sides of and substantially coextensive with the plurality of conductor sets along the length and width of the cable.

Embodiment 41 is a ribbon cable, comprising:

a plurality of substantially parallel insulated conductors extending along a length of the cable and arranged along a width of the cable, each insulated conductor having a diameter R and the conductor of the insulated conductor having a diameter r, R/r greater than 1 and less than about 2; and an insulative layer surrounding and adhered to the plurality of the insulated conductors, such that for each pair of adjacent insulated conductors in the plurality of insulated conductors, a center to center separation between the two insulated conductors is D, an average of the diameters of the two insulated conductors is d, $D/d \geq 1.05$.

Embodiment 42 is the ribbon cable of Embodiment 41, wherein the insulative layer comprises first and second insulative layers disposed on opposite sides of and substantially coextensive with the plurality of insulated conductors along the length and width of the cable.

Embodiment 43 is the ribbon cable of Embodiment 41 or 42, wherein at least one conductor in the plurality of insulated conductors has a propagation delay of less than about 4.75 nsec/meter, or less than about 4.5 nsec/meter, or less than about 4.25 nsec/meter, or less than about 4 nsec/meter, or less than about 3.75 nsec/meter at data transfer speeds from about 1 Gbps to about 20 Gbps.

Embodiment 44 is a ribbon cable, comprising:

a plurality of spaced apart substantially parallel insulated conductors extending along a length of the cable and arranged along a width of the cable, at least one insulated conductor insulated with a dielectric material having a dielectric constant of at least W; and an insulative layer surrounding and adhered to the plurality of the insulated conductors, an effective dielectric constant of the cable for a pair of adjacent insulated conductors that includes the at least one insulated conductor driven with differential signals of equal amplitude and opposite polarities is less than 0.8 times W.

Embodiment 45 is the ribbon cable of Embodiment 44, wherein each insulated conductor is insulated with a dielectric material having a dielectric constant greater than about 2.5, or greater than about 2.8, or greater than about 3, or greater than about 3.2, or greater than about 3.4, or greater than about 3.6, or greater than about 3.8, or greater than about 4.

Embodiment 46 is the ribbon cable of Embodiment 44 or 45, wherein W is about 2.5, or about 2.8, or about 3.

Embodiment 47 is the ribbon cable of any one of Embodiments 44 to 46, wherein the effective dielectric constant of the cable for at least one pair of adjacent insulated conductors driven with differential signals of equal amplitude and opposite polarities is less than about 2.5, or less than about 2.2, or less than about 2.0, or less than about 1.8, or less than about 1.7, or less than about 1.6, or less than about 1.5, or less than about 1.4, or less than about 1.3, or less than about 1.2.

Embodiment 48 is the ribbon cable of any one of Embodiments 44 to 47, wherein the insulative layer comprises first and second insulative layers disposed on opposite sides of and substantially coextensive with the plurality of insulated conductors along the length and width of the cable.

Embodiment 49 is the ribbon cable of Embodiment 48, wherein each of the first and second insulative layers comprises alternating substantially parallel thicker and thinner portions extending along the length of the cable, the thicker portions of the first and second insulative layers substantially aligned in one to one correspondence, each corresponding thicker portions of the first and second insulative layers having at least one conductor in the plurality of insulated conductors disposed therebetween.

Embodiment 50 is a ribbon cable, comprising:

a plurality of substantially parallel insulated conductors extending along a length of the cable and arranged along a width of the cable, each conductor in at least one pair of adjacent insulated conductors insulated with a dielectric material having a dielectric constant greater than about 2, a center to center separation between the two adjacent insulated conductors being D, an average of the diameters of the two insulated conductors being d, $D/d \geq 1.05$; and an insulative layer surrounding the plurality of the insulated conductors, the insulative layer having a thickness greater than about 200 microns and an effective dielectric constant of less than about 2, the dielectric material having an adhesive property and directly bonding the insulated conductors to the insulative layer, wherein an effective dielectric constant of the cable for at least one pair of adjacent insulated conductors driven with differential signals of equal amplitude and opposite polarities is less than about 2.5.

Embodiment 51 is the ribbon cable of Embodiment 50, wherein the dielectric material has a dielectric constant greater than about 2.5.

Embodiment 52 is a ribbon cable, comprising:

a plurality of spaced apart substantially parallel insulated conductors extending along a length of the cable and arranged along a width of the cable, each insulated conductor insulated with a dielectric material having a thickness≥0, for each pair of adjacent insulated conductors in the plurality of insulated conductors, a center to center separation between the two insulated conductors being D, an average of diameters of the two insulated conductors being d, D/d≥1.2; and first and second insulative layer portions disposed on opposite sides of and substantially coextensive with the plurality of insulated conductors across the length and width of the cable, a separation between the first and second insulative layer portions varying by no more than about 20% along the length and width of the cable, such that for at least one pair of adjacent insulated conductors:

an effective dielectric constant of the cable for the pair of insulated conductors driven with differential signals of equal amplitude and opposite polarities is less than about 2.2, and each of the insulated conductors has a propagation delay of less than about 4.75 nsec/meter at data transfer speeds from about 1 Gbps to about 20 Gbps.

Embodiment 53 is a ribbon cable, comprising:

a plurality of spaced apart substantially parallel insulated conductors extending along a length of the cable and arranged along a width of the cable, each insulated conductor insulated with a dielectric material having a thickness≥0, for each pair of adjacent insulated conductors in the plurality of insulated conductors, a center to center separation between the two insulated conductors being D, an average of diameters of the two insulated conductors being d, D/d≥1.2; and first and second insulative layer portions disposed on opposite sides of and substantially coextensive with the plurality of insulated conductors across the length and width of the cable, a separation between the first and second insulative layer portions varying by no more than about 20% along the length and width of the cable, such that for at least one pair of adjacent insulated conductors:

an effective dielectric constant of the cable for the pair of insulated conductors driven with differential signals of equal amplitude and opposite polarities is less than about 2.2, and each of the insulated conductors has a propagation delay of less than about 4.75 nsec/meter as determined using time domain reflectometry using a signal rise time of 35 picoseconds.

Embodiment 54 is the ribbon cable of Embodiment 52 or 53, wherein the thickness of the dielectric material of each insulated conductor is zero.

Embodiment 55 is the ribbon cable of Embodiment 52 or 53, wherein the thickness of the dielectric material of each insulated conductor is greater than zero.

Embodiment 56 is the ribbon cable of any one of Embodiments 52 to 55 comprising a single insulative layer wrapped around the plurality of insulated conductors and defining a top insulative layer portion comprising the first insulative layer portion and a bottom insulative layer portion comprising the second insulative layer portion.

Embodiment 57 is the ribbon cable of any one of Embodiments 52 to 55 comprising a first and second insulative layers disposed on opposite sides of the ribbon cable, each substantially coextensive with the plurality of insulated conductors across the length and width of the cable, the first insulative layer comprising the first insulative layer portion and the second insulative layer comprising the second insulative layer portion, the first and second insulative layers bonded to each other at each lateral end of the cable.

Embodiment 58 is the ribbon cable of any one of Embodiments 1 to 37 and 40 to 57, wherein the cable has a skew of less than about 20 psec/meter, or less than about 15 psec/meter, or less than about 10 psec/meter, or less than about 5 psec/meter at data transfer speeds from about 1 Gbps to about 50 Gbps, or about 1 Gbps to about 50 Gbps, or about 1 Gbps to about 75 Gbps, or about 1 Gbps to about 100 Gbps.

Embodiment 59 is the ribbon cable of any one of Embodiments 1 to 37 and 40 to 58, wherein the cable has a skew of less than about 20 psec/meter, or less than about 15 psec/meter, or less than about 10 psec/meter, or less than about 5 psec/meter as determined using time domain reflectometry using a signal rise time of 35 picoseconds.

Embodiment 60 is the ribbon cable of any one of Embodiments 1 to 37 and 40 to 59, wherein at least one conductor in the plurality of conductors has a propagation delay of less than about 4.75 nsec/meter, or less than about 4.5 nsec/meter, or less than about 4.25 nsec/meter, or less than about 4 nsec/meter, or less than about 3.75 nsec/meter at data transfer speeds from about 1 Gbps to about 20 Gbps, or about 1 Gbps to about 50 Gbps, or about 1 Gbps to about 75 Gbps, or about 1 Gbps to about 100 Gbps.

Embodiment 61 is the ribbon cable of any one of Embodiments 1 to 37 and 40 to 60, wherein at least one conductor in the plurality of conductors has a propagation delay of less than about 4.75 nsec/meter, or less than about 4.5 nsec/meter, or less than about 4.25 nsec/meter, or less than about 4 nsec/meter, or less than about 3.75 nsec/meter as determined using time domain reflectometry using a signal rise time of 35 picoseconds.

Examples

A cable as depicted in FIG. 16 was modeled using finite-element techniques. The insulative layer 630 was modeled as having a uniform thickness t1. The conductors 520*a* and 520*d* were ground wires and the conductors 520*b* and 520*c* were signal wires in the calculation. The center-to-center spacing between the conductor 520*a* and 520*b* and between the conductor 520*c* and 520*d* were equal and are referred to as the signal-ground spacing in the tables below. The center-to-center spacing D between the conductors 520*b* and 520*c* is referred to as the signal-signal spacing in the table below. The dielectric material 555 was modeled as having a same thickness and same dielectric constant. The conductors 520 were modeled as 26 AWG round conductors which have a radius of 7.95 mils. The impedance, $Z_0$, the effective dielectric constant of the cable driven with differential signals of equal amplitude and opposite polarities, $k_{eff}$, and the time delay per unit length, $t_d$, were calculated. Results are shown in Tables 1-5 for a thickness of the dielectric material 555 of 0 mils (Table 1), 0.5 mils (Table 2), 2 mils (Tables 3A-3C), 3 mils (Table 4) and 7.95 mils (Table 5). The dielectric material 555 was modeled as a polyolefin having a dielectric constant of 2.25 except where indicated in Table 2. The effective dielectric constant of the cover layer (insulative layer 630) was varied from 1.2 to 2.25 (corresponding to a solid polyolefin layer). It was found that a wide range of insulative layer thickness, effective dielectric constant of the insulative layer, and conductor spacing resulted in an impedance in the range of 70 to 110 ohms.

Figure 19:
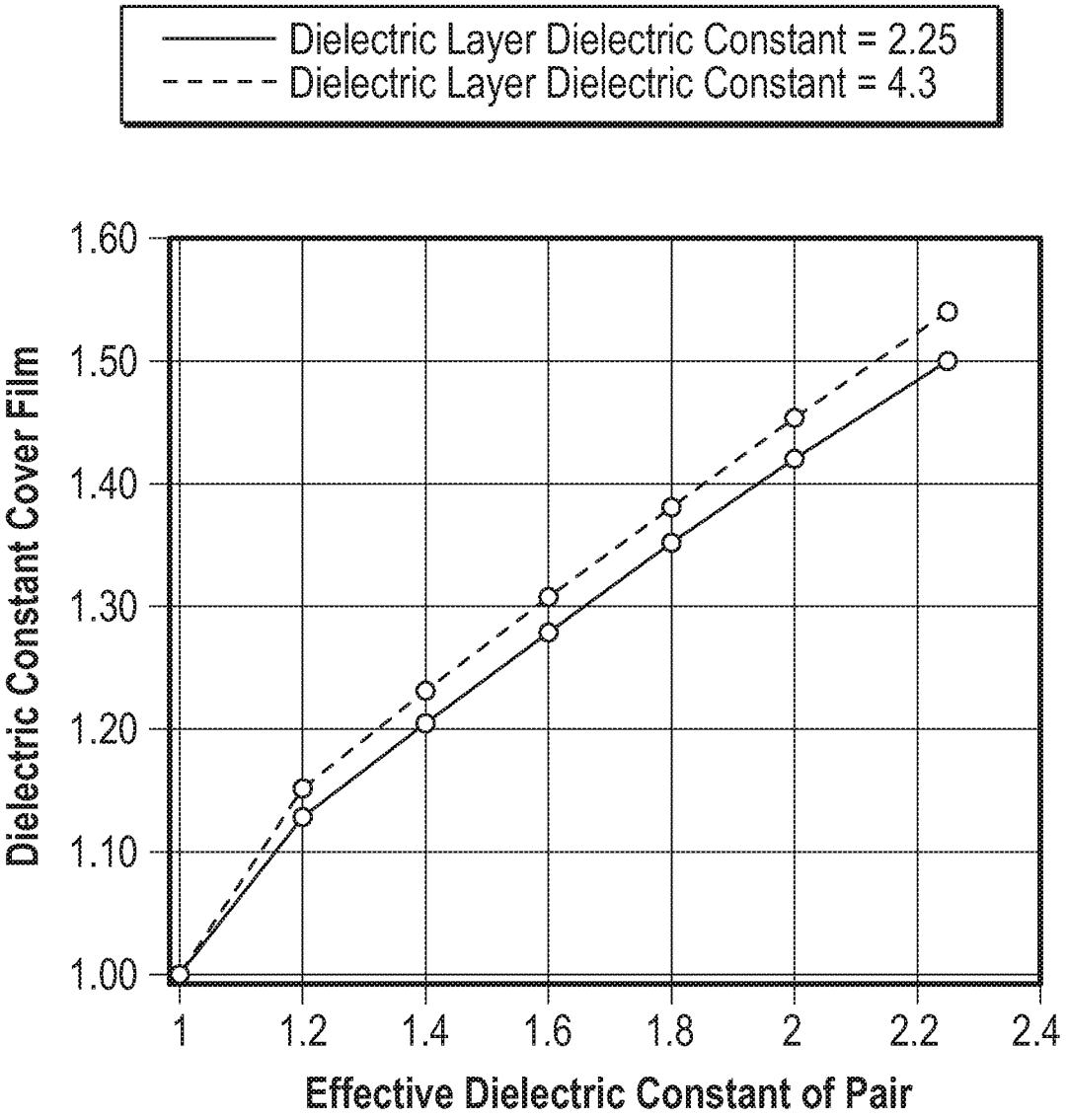
FIG. 19 is a plot of the effective dielectric constant of an insulative layer versus the effective dielectric constant of a cable.

The cable was also modeled for a thickness of 0.5 mils of the dielectric material 555 using a dielectric constant of 2.25 or 4.3 for a variety of effective dielectric constants of the insulative layer. The relationship between the effective dielectric constant of the insulative layer and the effective dielectric constant for the cable when the signal wires are driven with differential signals of equal amplitude and opposite polarities is shown in FIG. 19.

TABLE 1

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 30.0 | 23.0 | 15.0 | 1.20 | 102 | 1.08 | 3.47 |
| 30.0 | 23.0 | 20.0 | 1.20 | 106 | 1.08 | 3.47 |
| 35.0 | 25.5 | 15.0 | 1.20 | 115 | 1.09 | 3.49 |
| 40.0 | 28.0 | 10.0 | 1.20 | 109 | 1.11 | 3.51 |
| 40.0 | 28.0 | 15.0 | 1.20 | 124 | 1.10 | 3.50 |
| 45.0 | 30.5 | 5.0 | 1.20 | 80 | 1.12 | 3.52 |
| 30.0 | 23.0 | 15.0 | 1.40 | 98 | 1.16 | 3.60 |
| 30.0 | 23.0 | 20.0 | 1.40 | 102 | 1.16 | 3.59 |
| 35.0 | 25.5 | 15.0 | 1.40 | 110 | 1.18 | 3.63 |
| 40.0 | 28.0 | 10.0 | 1.40 | 104 | 1.21 | 3.67 |
| 40.0 | 28.0 | 15.0 | 1.40 | 119 | 1.20 | 3.66 |
| 45.0 | 30.5 | 5.0 | 1.40 | 76 | 1.23 | 3.69 |
| 30.0 | 23.0 | 15.0 | 1.60 | 95 | 1.24 | 3.72 |
| 30.0 | 23.0 | 20.0 | 1.60 | 99 | 1.23 | 3.70 |
| 35.0 | 25.5 | 15.0 | 1.60 | 106 | 1.27 | 3.76 |
| 40.0 | 28.0 | 10.0 | 1.60 | 100 | 1.31 | 3.82 |
| 40.0 | 28.0 | 15.0 | 1.60 | 114 | 1.30 | 3.80 |
| 45.0 | 30.5 | 5.0 | 1.60 | 73 | 1.33 | 3.85 |
| 30.0 | 23.0 | 15.0 | 1.80 | 92 | 1.32 | 3.83 |
| 30.0 | 23.0 | 20.0 | 1.80 | 96 | 1.31 | 3.81 |
| 35.0 | 25.5 | 15.0 | 1.80 | 103 | 1.36 | 3.89 |
| 40.0 | 28.0 | 10.0 | 1.80 | 96 | 1.41 | 3.96 |
| 40.0 | 28.0 | 15.0 | 1.80 | 110 | 1.39 | 3.94 |
| 45.0 | 30.5 | 5.0 | 1.80 | 71 | 1.43 | 3.99 |
| 30.0 | 23.0 | 15.0 | 2.00 | 90 | 1.39 | 3.93 |
| 30.0 | 23.0 | 20.0 | 2.00 | 93 | 1.38 | 3.92 |
| 35.0 | 25.5 | 15.0 | 2.00 | 100 | 1.44 | 4.01 |
| 40.0 | 28.0 | 10.0 | 2.00 | 93 | 1.50 | 4.09 |
| 40.0 | 28.0 | 15.0 | 2.00 | 107 | 1.48 | 4.06 |
| 45.0 | 30.5 | 5.0 | 2.00 | 69 | 1.53 | 4.12 |
| 30.0 | 23.0 | 15.0 | 2.25 | 87 | 1.48 | 4.06 |
| 30.0 | 23.0 | 20.0 | 2.25 | 91 | 1.47 | 4.04 |
| 35.0 | 25.5 | 15.0 | 2.25 | 97 | 1.55 | 4.15 |
| 40.0 | 28.0 | 10.0 | 2.25 | 90 | 1.62 | 4.24 |
| 40.0 | 28.0 | 15.0 | 2.25 | 103 | 1.60 | 4.21 |
| 45.0 | 30.5 | 5.0 | 2.25 | 66 | 1.64 | 4.27 |

TABLE 2

| Signal-Signal Spacing (mil) | Signal-Ground Spacing (mil) | Dielectric Layer Dielectric Constant | Cover Layer Dielectric Constant | $Z_0$ (ohm) | $k_{eff}$ | $t_d$ (ns/m) |
|---|---|---|---|---|---|---|
| 30.0 | 23.0 | 2.25 | 1.20 | 100 | 1.13 | 3.54 |
| 30.0 | 23.0 | 2.25 | 1.40 | 97 | 1.21 | 3.66 |
| 30.0 | 23.0 | 2.25 | 1.60 | 94 | 1.28 | 3.77 |
| 30.0 | 23.0 | 2.25 | 1.80 | 92 | 1.35 | 3.88 |
| 30.0 | 23.0 | 2.25 | 2.00 | 89 | 1.42 | 3.97 |
| 30.0 | 23.0 | 2.25 | 2.25 | 87 | 1.50 | 4.09 |
| 30.0 | 23.0 | 4.3 | 1.20 | 99 | 1.15 | 3.58 |
| 30.0 | 23.0 | 4.3 | 1.40 | 96 | 1.23 | 3.70 |
| 30.0 | 23.0 | 4.3 | 1.60 | 93 | 1.31 | 3.81 |
| 30.0 | 23.0 | 4.3 | 1.80 | 91 | 1.38 | 3.92 |
| 30.0 | 23.0 | 4.3 | 2.00 | 88 | 1.45 | 4.02 |
| 30.0 | 23.0 | 4.3 | 2.25 | 86 | 1.54 | 4.14 |

TABLE 3A

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 25.0 | 20.5 | 10.0 | 1.20 | 71 | 1.41 | 3.96 |
| 30.0 | 23.0 | 15.0 | 1.20 | 95 | 1.29 | 3.79 |
| 30.0 | 23.0 | 20.0 | 1.20 | 97 | 1.29 | 3.79 |

TABLE 3A-continued

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 32.0 | 24.0 | 15.0 | 1.20 | 101 | 1.27 | 3.76 |
| 32.0 | 24.0 | 20.0 | 1.20 | 105 | 1.27 | 3.76 |
| 35.0 | 25.5 | 9.0 | 1.20 | 98 | 1.27 | 3.76 |
| 25.0 | 20.5 | 10.0 | 1.40 | 69 | 1.46 | 4.03 |
| 30.0 | 23.0 | 15.0 | 1.40 | 93 | 1.36 | 3.88 |
| 30.0 | 23.0 | 20.0 | 1.40 | 95 | 1.35 | 3.88 |
| 32.0 | 24.0 | 15.0 | 1.40 | 99 | 1.34 | 3.86 |
| 32.0 | 24.0 | 20.0 | 1.40 | 102 | 1.34 | 3.86 |
| 35.0 | 25.5 | 9.0 | 1.40 | 95 | 1.35 | 3.88 |
| 25.0 | 20.5 | 10.0 | 1.60 | 68 | 1.51 | 4.10 |
| 30.0 | 23.0 | 15.0 | 1.60 | 90 | 1.42 | 3.97 |
| 30.0 | 23.0 | 20.0 | 1.60 | 93 | 1.41 | 3.96 |
| 32.0 | 24.0 | 15.0 | 1.60 | 96 | 1.41 | 3.96 |
| 32.0 | 24.0 | 20.0 | 1.60 | 100 | 1.40 | 3.95 |
| 35.0 | 25.5 | 9.0 | 1.60 | 93 | 1.42 | 3.98 |
| 25.0 | 20.5 | 10.0 | 1.80 | 67 | 1.56 | 4.17 |
| 30.0 | 23.0 | 15.0 | 1.80 | 89 | 1.48 | 4.05 |
| 30.0 | 23.0 | 20.0 | 1.80 | 91 | 1.47 | 4.04 |
| 32.0 | 24.0 | 15.0 | 1.80 | 94 | 1.47 | 4.04 |
| 32.0 | 24.0 | 20.0 | 1.80 | 97 | 1.46 | 4.03 |
| 35.0 | 25.5 | 9.0 | 1.80 | 91 | 1.50 | 4.08 |
| 25.0 | 20.5 | 10.0 | 2.00 | 66 | 1.60 | 4.22 |
| 30.0 | 23.0 | 15.0 | 2.00 | 87 | 1.53 | 4.13 |
| 30.0 | 23.0 | 20.0 | 2.00 | 90 | 1.52 | 4.12 |
| 32.0 | 24.0 | 15.0 | 2.00 | 92 | 1.53 | 4.12 |
| 32.0 | 24.0 | 20.0 | 2.00 | 96 | 1.52 | 4.11 |
| 35.0 | 25.5 | 9.0 | 2.00 | 89 | 1.56 | 4.17 |
| 25.0 | 20.5 | 10.0 | 2.25 | 65 | 1.66 | 4.29 |
| 30.0 | 23.0 | 15.0 | 2.25 | 85 | 1.60 | 4.21 |
| 30.0 | 23.0 | 20.0 | 2.25 | 88 | 1.59 | 4.20 |
| 32.0 | 24.0 | 15.0 | 2.25 | 90 | 1.60 | 4.22 |
| 32.0 | 24.0 | 20.0 | 2.25 | 94 | 1.59 | 4.20 |
| 35.0 | 25.5 | 9.0 | 2.25 | 87 | 1.64 | 4.27 |

TABLE 3B

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 35.0 | 25.5 | 10.0 | 1.20 | 101 | 1.26 | 3.75 |
| 35.0 | 25.5 | 15.0 | 1.20 | 110 | 1.25 | 3.73 |
| 35.0 | 25.5 | 20.0 | 1.20 | 114 | 1.25 | 3.73 |
| 38.5 | 27.2 | 9.0 | 1.20 | 104 | 1.26 | 3.74 |
| 40.0 | 28.0 | 9.0 | 1.20 | 106 | 1.26 | 3.74 |
| 40.0 | 28.0 | 10.0 | 1.20 | 109 | 1.25 | 3.73 |
| 35.0 | 25.5 | 10.0 | 1.40 | 98 | 1.34 | 3.87 |
| 35.0 | 25.5 | 15.0 | 1.40 | 107 | 1.33 | 3.85 |
| 35.0 | 25.5 | 20.0 | 1.40 | 111 | 1.32 | 3.84 |
| 38.5 | 27.2 | 9.0 | 1.40 | 100 | 1.35 | 3.87 |
| 40.0 | 28.0 | 9.0 | 1.40 | 102 | 1.35 | 3.87 |
| 40.0 | 28.0 | 10.0 | 1.40 | 105 | 1.34 | 3.86 |
| 35.0 | 25.5 | 10.0 | 1.60 | 95 | 1.42 | 3.97 |
| 35.0 | 25.5 | 15.0 | 1.60 | 104 | 1.40 | 3.95 |
| 35.0 | 25.5 | 20.0 | 1.60 | 108 | 1.39 | 3.94 |
| 38.5 | 27.2 | 9.0 | 1.60 | 97 | 1.43 | 3.98 |
| 40.0 | 28.0 | 9.0 | 1.60 | 99 | 1.43 | 3.99 |
| 40.0 | 28.0 | 10.0 | 1.60 | 102 | 1.42 | 3.98 |
| 35.0 | 25.5 | 10.0 | 1.80 | 93 | 1.49 | 4.07 |
| 35.0 | 25.5 | 15.0 | 1.80 | 101 | 1.47 | 4.04 |
| 35.0 | 25.5 | 20.0 | 1.80 | 106 | 1.46 | 4.03 |
| 38.5 | 27.2 | 9.0 | 1.80 | 95 | 1.50 | 4.09 |
| 40.0 | 28.0 | 9.0 | 1.80 | 96 | 1.51 | 4.09 |
| 40.0 | 28.0 | 10.0 | 1.80 | 100 | 1.50 | 4.08 |
| 35.0 | 25.5 | 10.0 | 2.00 | 91 | 1.56 | 4.16 |
| 35.0 | 25.5 | 15.0 | 2.00 | 99 | 1.53 | 4.13 |
| 35.0 | 25.5 | 20.0 | 2.00 | 103 | 1.52 | 4.12 |
| 38.5 | 27.2 | 9.0 | 2.00 | 93 | 1.57 | 4.18 |
| 40.0 | 28.0 | 9.0 | 2.00 | 94 | 1.58 | 4.19 |
| 40.0 | 28.0 | 10.0 | 2.00 | 97 | 1.57 | 4.18 |
| 35.0 | 25.5 | 10.0 | 2.25 | 89 | 1.63 | 4.26 |

TABLE 3B-continued

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 35.0 | 25.5 | 15.0 | 2.25 | 97 | 1.61 | 4.23 |
| 35.0 | 25.5 | 20.0 | 2.25 | 101 | 1.60 | 4.22 |
| 38.5 | 27.2 | 9.0 | 2.25 | 90 | 1.65 | 4.29 |
| 40.0 | 28.0 | 9.0 | 2.25 | 92 | 1.67 | 4.31 |
| 40.0 | 28.0 | 10.0 | 2.25 | 95 | 1.66 | 4.29 |

TABLE 3C

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 40.0 | 28.0 | 15.0 | 1.20 | 121 | 1.24 | 3.71 |
| 43.0 | 29.5 | 12.0 | 1.20 | 119 | 1.24 | 3.71 |
| 45.0 | 30.5 | 5.0 | 1.20 | 89 | 1.29 | 3.79 |
| 45.0 | 30.5 | 10.0 | 1.20 | 114 | 1.25 | 3.72 |
| 45.0 | 30.5 | 20.0 | 1.20 | 137 | 1.22 | 3.69 |
| 65.0 | 40.5 | 5.0 | 1.20 | 91 | 1.29 | 3.79 |
| 40.0 | 28.0 | 15.0 | 1.40 | 117 | 1.32 | 3.84 |
| 43.0 | 29.5 | 12.0 | 1.40 | 115 | 1.33 | 3.85 |
| 45.0 | 30.5 | 5.0 | 1.40 | 86 | 1.38 | 3.92 |
| 45.0 | 30.5 | 10.0 | 1.40 | 110 | 1.34 | 3.86 |
| 45.0 | 30.5 | 20.0 | 1.40 | 132 | 1.31 | 3.82 |
| 65.0 | 40.5 | 5.0 | 1.40 | 88 | 1.39 | 3.93 |
| 40.0 | 28.0 | 15.0 | 1.60 | 113 | 1.40 | 3.95 |
| 43.0 | 29.5 | 12.0 | 1.60 | 111 | 1.42 | 3.97 |
| 45.0 | 30.5 | 5.0 | 1.60 | 83 | 1.47 | 4.04 |
| 45.0 | 30.5 | 10.0 | 1.60 | 107 | 1.43 | 3.99 |
| 45.0 | 30.5 | 20.0 | 1.60 | 128 | 1.40 | 3.94 |
| 65.0 | 40.5 | 5.0 | 1.60 | 85 | 1.48 | 4.05 |
| 40.0 | 28.0 | 15.0 | 1.80 | 110 | 1.48 | 4.06 |
| 43.0 | 29.5 | 12.0 | 1.80 | 108 | 1.50 | 4.08 |
| 45.0 | 30.5 | 5.0 | 1.80 | 81 | 1.54 | 4.14 |
| 45.0 | 30.5 | 10.0 | 1.80 | 104 | 1.51 | 4.10 |
| 45.0 | 30.5 | 20.0 | 1.80 | 124 | 1.48 | 4.06 |
| 65.0 | 40.5 | 5.0 | 1.80 | 83 | 1.56 | 4.16 |
| 40.0 | 28.0 | 15.0 | 2.00 | 108 | 1.55 | 4.15 |
| 43.0 | 29.5 | 12.0 | 2.00 | 105 | 1.57 | 4.18 |
| 45.0 | 30.5 | 5.0 | 2.00 | 79 | 1.61 | 4.23 |
| 45.0 | 30.5 | 10.0 | 2.00 | 101 | 1.59 | 4.20 |
| 45.0 | 30.5 | 20.0 | 2.00 | 121 | 1.56 | 4.16 |
| 65.0 | 40.5 | 5.0 | 2.00 | 81 | 1.63 | 4.26 |
| 40.0 | 28.0 | 15.0 | 2.25 | 105 | 1.64 | 4.27 |
| 43.0 | 29.5 | 12.0 | 2.25 | 103 | 1.66 | 4.30 |
| 45.0 | 30.5 | 5.0 | 2.25 | 77 | 1.69 | 4.34 |
| 45.0 | 30.5 | 10.0 | 2.25 | 98 | 1.68 | 4.32 |
| 45.0 | 30.5 | 20.0 | 2.25 | 118 | 1.65 | 4.28 |
| 65.0 | 40.5 | 5.0 | 2.25 | 79 | 1.71 | 4.37 |

TABLE 4

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 30.0 | 23.0 | 15.0 | 1.20 | 91 | 1.43 | 3.99 |
| 30.0 | 23.0 | 20.0 | 1.20 | 93 | 1.43 | 3.99 |
| 35.0 | 25.5 | 15.0 | 1.20 | 107 | 1.35 | 3.87 |
| 40.0 | 28.0 | 10.0 | 1.20 | 109 | 1.32 | 3.84 |
| 40.0 | 28.0 | 15.0 | 1.20 | 119 | 1.31 | 3.82 |
| 45.0 | 30.5 | 5.0 | 1.20 | 92 | 1.36 | 3.89 |
| 30.0 | 23.0 | 15.0 | 1.40 | 89 | 1.49 | 4.07 |
| 30.0 | 23.0 | 20.0 | 1.40 | 91 | 1.48 | 4.06 |
| 35.0 | 25.5 | 15.0 | 1.40 | 104 | 1.41 | 3.97 |
| 40.0 | 28.0 | 10.0 | 1.40 | 105 | 1.41 | 3.96 |
| 40.0 | 28.0 | 15.0 | 1.40 | 115 | 1.39 | 3.93 |
| 45.0 | 30.5 | 5.0 | 1.40 | 89 | 1.45 | 4.01 |
| 30.0 | 23.0 | 15.0 | 1.60 | 87 | 1.54 | 4.14 |

TABLE 4-continued

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 30.0 | 23.0 | 20.0 | 1.60 | 89 | 1.54 | 4.14 |
| 35.0 | 25.5 | 15.0 | 1.60 | 102 | 1.48 | 4.06 |
| 40.0 | 28.0 | 10.0 | 1.60 | 103 | 1.48 | 4.06 |
| 40.0 | 28.0 | 15.0 | 1.60 | 112 | 1.46 | 4.03 |
| 45.0 | 30.5 | 5.0 | 1.60 | 87 | 1.52 | 4.12 |
| 30.0 | 23.0 | 15.0 | 1.80 | 86 | 1.59 | 4.21 |
| 30.0 | 23.0 | 20.0 | 1.80 | 88 | 1.59 | 4.20 |
| 35.0 | 25.5 | 15.0 | 1.80 | 100 | 1.54 | 4.14 |
| 40.0 | 28.0 | 10.0 | 1.80 | 100 | 1.55 | 4.15 |
| 40.0 | 28.0 | 15.0 | 1.80 | 110 | 1.53 | 4.13 |
| 45.0 | 30.5 | 5.0 | 1.80 | 85 | 1.59 | 4.21 |
| 30.0 | 23.0 | 15.0 | 2.00 | 85 | 1.64 | 4.27 |
| 30.0 | 23.0 | 20.0 | 2.00 | 87 | 1.63 | 4.26 |
| 35.0 | 25.5 | 15.0 | 2.00 | 98 | 1.60 | 4.22 |
| 40.0 | 28.0 | 10.0 | 2.00 | 98 | 1.61 | 4.24 |
| 40.0 | 28.0 | 15.0 | 2.00 | 108 | 1.59 | 4.21 |
| 45.0 | 30.5 | 5.0 | 2.00 | 84 | 1.65 | 4.29 |
| 30.0 | 23.0 | 15.0 | 2.25 | 83 | 1.70 | 4.34 |
| 30.0 | 23.0 | 20.0 | 2.25 | 85 | 1.69 | 4.34 |
| 35.0 | 25.5 | 15.0 | 2.25 | 96 | 1.66 | 4.30 |
| 40.0 | 28.0 | 10.0 | 2.25 | 96 | 1.69 | 4.33 |
| 40.0 | 28.0 | 15.0 | 2.25 | 105 | 1.67 | 4.31 |
| 45.0 | 30.5 | 5.0 | 2.25 | 82 | 1.72 | 4.37 |

TABLE 5

| Signal-Signal Spacing (mil) | Signal-Ground Spacing (mil) | Cover Layer Thickness (mil) | Cover Layer Dielectric Constant | $Z_0$ (ohm) | $k_{eff}$ | $t_d$ (ns/m) |
|---|---|---|---|---|---|---|
| 32.0 | 32.0 | 10.0 | 1.20 | 94 | 1.82 | 4.50 |
| 40.0 | 32.0 | 5.0 | 1.20 | 98 | 1.72 | 4.37 |
| 40.0 | 28.0 | 10.0 | 1.20 | 109 | 1.67 | 4.32 |
| 45.0 | 30.5 | 5.0 | 1.20 | 101 | 1.70 | 4.35 |
| 32.0 | 32.0 | 10.0 | 1.40 | 93 | 1.87 | 4.56 |
| 40.0 | 32.0 | 5.0 | 1.40 | 97 | 1.77 | 4.44 |
| 40.0 | 28.0 | 10.0 | 1.40 | 107 | 1.73 | 4.39 |
| 45.0 | 30.5 | 5.0 | 1.40 | 100 | 1.75 | 4.42 |
| 32.0 | 32.0 | 10.0 | 1.60 | 92 | 1.91 | 4.60 |
| 40.0 | 32.0 | 5.0 | 1.60 | 96 | 1.81 | 4.49 |
| 40.0 | 28.0 | 10.0 | 1.60 | 106 | 1.78 | 4.45 |
| 45.0 | 30.5 | 5.0 | 1.60 | 99 | 1.80 | 4.47 |
| 32.0 | 32.0 | 10.0 | 1.80 | 91 | 1.94 | 4.65 |
| 40.0 | 32.0 | 5.0 | 1.80 | 95 | 1.85 | 4.53 |
| 40.0 | 28.0 | 10.0 | 1.80 | 105 | 1.82 | 4.50 |
| 45.0 | 30.5 | 5.0 | 1.80 | 98 | 1.84 | 4.52 |
| 32.0 | 32.0 | 10.0 | 2.00 | 91 | 1.97 | 4.68 |
| 40.0 | 32.0 | 5.0 | 2.00 | 94 | 1.88 | 4.57 |
| 40.0 | 28.0 | 10.0 | 2.00 | 103 | 1.86 | 4.55 |
| 45.0 | 30.5 | 5.0 | 2.00 | 97 | 1.87 | 4.56 |
| 32.0 | 32.0 | 10.0 | 2.25 | 90 | 2.01 | 4.72 |
| 40.0 | 32.0 | 5.0 | 2.25 | 93 | 1.91 | 4.61 |
| 40.0 | 28.0 | 10.0 | 2.25 | 102 | 1.90 | 4.60 |
| 45.0 | 30.5 | 5.0 | 2.25 | 96 | 1.91 | 4.61 |

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure.

This application is intended to cover any adaptations or variations of the specific embodiments discussed herein. Therefore, it is intended that this disclosure be limited only by the claims and the equivalents thereof

What is claimed is:

1. A conductor set, comprising:

a plurality of spaced apart substantially parallel conductors extending along a length of the conductor set and arranged along a width of the conductor set;

first and second non-conductive structured layers disposed on opposite sides of, and substantially coextensive with, the plurality of conductors along the length and width of the conductor set, each structured layer adhered to the conductors and comprising a plurality of higher dielectric constant regions defining a plurality of lower dielectric constant regions therebetween, each structured layer having an effective dielectric constant less than about 2; and a conductive shielding layer wrapped around the first and second non-conductive structured layers.

2. The conductor set of claim 1, wherein each structured layer has an effective dielectric constant less than about 1.8.

3. The conductor set of claim 1, wherein each structured layer has an effective dielectric constant less than about 1.6.

4. A shielded ribbon cable, comprising:

a plurality of spaced apart substantially parallel conductor sets of claim 1 arranged along a width of the cable; and first and second insulative layers disposed on opposite sides of and substantially coextensive with the plurality of conductor sets along the length and width of the cable.

5. The shielded ribbon cable of claim 4 having a skew of less than about 20 psec/meter at data transfer speeds from about 1 Gbps to about 20 Gbps.

6. The shielded ribbon cable of claim 4, wherein at least one conductor in the plurality of spaced apart substantially parallel conductors has a propagation delay of less than about 4.75 nsec/meter at data transfer speeds from about 1 Gbps to about 20 Gbps.

7. The shielded ribbon cable of claim 4, wherein an effective dielectric constant of the cable for at least one pair of adjacent conductors driven with differential signals of equal amplitude and opposite polarities is less than about 2.2.

8. The shielded ribbon cable of claim 4, wherein for each conductor set:

at least one conductor of the plurality of spaced apart substantially parallel conductors is insulated with a dielectric material having a dielectric constant of at least W; and an effective dielectric constant of the cable for a pair of adjacent conductors that includes the at least one conductor driven with differential signals of equal amplitude and opposite polarities is less than 0.8 times W.

9. The shielded ribbon cable of claim 8, wherein W is about 2.5.

10. A ribbon cable, comprising:

a plurality of spaced apart substantially parallel insulated conductors extending along a length of the cable and arranged along a width of the cable, at least one insulated conductor insulated with a dielectric material having a dielectric constant of at least W; and an insulative layer surrounding and adhered to the plurality of the insulated conductors, an effective dielectric constant of the cable for a pair of adjacent insulated conductors that includes the at least one insulated conductor driven with differential signals of equal amplitude and opposite polarities is less than 0.8 times W.

11. The ribbon cable of claim 10, wherein each insulated conductor is insulated with a dielectric material having a dielectric constant greater than about 2.5.

12. The ribbon cable of claim 11, wherein the effective dielectric constant of the cable for at least one pair of adjacent insulated conductors driven with differential signals of equal amplitude and opposite polarities is less than about 2.5.

13. The ribbon cable of claim 11, wherein the effective dielectric constant of the cable for at least one pair of adjacent insulated conductors driven with differential signals of equal amplitude and opposite polarities is less than about 2.0.

14. The ribbon cable of claim 11, wherein the effective dielectric constant of the cable for at least one pair of adjacent insulated conductors driven with differential signals of equal amplitude and opposite polarities is less than about 1.8.

15. The ribbon cable of claim 10 having a skew of less than about 20 psec/meter at data transfer speeds from about 1 Gbps to about 20 Gbps.

16. The ribbon cable of claim 10, wherein at least one conductor in the plurality of spaced apart substantially parallel insulated conductors has a propagation delay of less than about 4.75 nsec/meter at data transfer speeds from about 1 Gbps to about 20 Gbps.

17. The ribbon cable of claim 10, wherein the insulative layer comprises first and second insulative layer portions disposed on opposite sides of and substantially coextensive with the plurality of conductors along the length and width of the cable, each insulative layer portion adhered to the conductors and comprising alternating substantially parallel thicker and thinner portions extending along the length of the cable.

* * * * *